US006414658B1

(12) United States Patent
Tokunaga

(10) Patent No.: US 6,414,658 B1
(45) Date of Patent: Jul. 2, 2002

(54) METHOD FOR DRIVING A PLASMA DISPLAY PANEL

(75) Inventor: Tsutomu Tokunaga, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/457,008

(22) Filed: Dec. 8, 1999

(30) Foreign Application Priority Data

| | | |
|---|---|---|
| Dec. 25, 1998 | (JP) | 10-371227 |
| Jan. 11, 1999 | (JP) | 11-004369 |
| Apr. 2, 1999 | (JP) | 11-096886 |
| Apr. 2, 1999 | (JP) | 11-096887 |

(51) Int. Cl.[7] ..... G09G 3/28
(52) U.S. Cl. ..... 345/63; 345/208
(58) Field of Search ..... 345/60–68, 63, 345/204, 208–210, 215, 690–693

(56) References Cited

U.S. PATENT DOCUMENTS 5,835,072 A * 11/1998 Kanazawa ..... 345/60
6,088,010 A * 7/2000 Makino et al. ..... 345/55

* cited by examiner

*Primary Examiner*—Richard Hjerpe
*Assistant Examiner*—Alexander Eisen
(74) *Attorney, Agent, or Firm*—Sughrue Mion, PLLC

(57) ABSTRACT

To improve display quality a reset step is executed for initializing all discharge cells into a light-emitting state only in the head sub-field within one field. Then pixel data is applied to column electrodes and scan pulses are applied to row electrodes for setting discharge cells to non-light-emitting state in all sub-fields within the field so that a discharge is generated for causing cells to emit light according to a weight of corresponding sub-field. Additionally, the pulse voltage of the scan pulse of the sub-field belonging to a group including the head sub-field is set larger than respective values of the scan pulse of a sub-field belonging to another group. In another embodiment at least one of the values of the pulse width and pulse voltage of the sustain pulse to be applied at the light-emission sustaining step is set larger than the value of the pulse width and the pulse voltage of the sustain pulse to be applied at some midpoint in the same light-emission sustaining step.

19 Claims, 28 Drawing Sheets

FIG. 6

SELECTIVE ERASING

| GRAY SCALE | LIGHT-EMISSION DRIVE PATTERN IN ONE FIELD | | | | | | | | | | | | | | LIGHT-EMISSION BRIGHTNESS |
|---|---|---|---|---|---|---|---|---|---|---|---|---|---|---|---|
| | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1 | ● | | | | | | | | | | | | | | 0 |
| 2 | ○ | ● | | | | | | | | | | | | | 1 |
| 3 | ○ | ○ | ● | | | | | | | | | | | | 4 |
| 4 | ○ | ○ | ○ | ● | | | | | | | | | | | 9 |
| 5 | ○ | ○ | ○ | ○ | ● | | | | | | | | | | 17 |
| 6 | ○ | ○ | ○ | ○ | ○ | ● | | | | | | | | | 27 |
| 7 | ○ | ○ | ○ | ○ | ○ | ○ | ● | | | | | | | | 40 |
| 8 | ○ | ○ | ○ | ○ | ○ | ○ | ○ | ● | | | | | | | 56 |
| 9 | ○ | ○ | ○ | ○ | ○ | ○ | ○ | ○ | ● | | | | | | 75 |
| 10 | ○ | ○ | ○ | ○ | ○ | ○ | ○ | ○ | ○ | ● | | | | | 97 |
| 11 | ○ | ○ | ○ | ○ | ○ | ○ | ○ | ○ | ○ | ○ | ● | | | | 122 |
| 12 | ○ | ○ | ○ | ○ | ○ | ○ | ○ | ○ | ○ | ○ | ○ | ● | | | 150 |
| 13 | ○ | ○ | ○ | ○ | ○ | ○ | ○ | ○ | ○ | ○ | ○ | ○ | ● | | 182 |
| 14 | ○ | ○ | ○ | ○ | ○ | ○ | ○ | ○ | ○ | ○ | ○ | ○ | ○ | ● | 217 |
| 15 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 14

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| MODE 1 | 1 | 3 | 5 | 8 | 10 | 13 | 16 | 19 | 22 | 25 | 28 | 32 | 35 | 39 |
| MODE 2 | 2 | 6 | 10 | 16 | 20 | 26 | 32 | 38 | 44 | 50 | 56 | 64 | 70 | 78 |
| MODE 3 | 3 | 9 | 15 | 24 | 30 | 39 | 48 | 57 | 66 | 75 | 84 | 96 | 105 | 117 |
| MODE 4 | 4 | 12 | 20 | 32 | 40 | 52 | 64 | 76 | 88 | 100 | 112 | 128 | 140 | 156 |

FIG. 16

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 7 | BRIGHT-NESS | 0 ~ 7 | BRIGHT-NESS | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 17

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 7 | BRIGHT-NESS | 0 ~ 7 | BRIGHT-NESS | 0 ~ 7 |
| 128 | 10000000 | 112 | 0111 0000 | 192 | 11000000 | 168 | 10101000 |
| 129 | 10000001 | 113 | 0111 0001 | 193 | 11000001 | 169 | 10101001 |
| 130 | 10000010 | 114 | 0111 0010 | 194 | 11000010 | 170 | 10101010 |
| 131 | 10000011 | 115 | 0111 0011 | 195 | 11000011 | 171 | 10101011 |
| 132 | 10000100 | 115 | 0111 0011 | 196 | 11000100 | 172 | 10101100 |
| 133 | 10000101 | 116 | 0111 0100 | 197 | 11000101 | 173 | 10101101 |
| 134 | 10000110 | 117 | 0111 0101 | 198 | 11000110 | 173 | 10101101 |
| 135 | 10000111 | 118 | 0111 0110 | 199 | 11000111 | 174 | 10101110 |
| 136 | 10001000 | 119 | 0111 0111 | 200 | 11001000 | 175 | 10101111 |
| 137 | 10001001 | 120 | 0111 1000 | 201 | 11001001 | 176 | 10110000 |
| 138 | 10001010 | 121 | 0111 1001 | 202 | 11001010 | 177 | 10110001 |
| 139 | 10001011 | 122 | 0111 1010 | 203 | 11001011 | 178 | 10110010 |
| 140 | 10001100 | 122 | 0111 1010 | 204 | 11001100 | 179 | 10110011 |
| 141 | 10001101 | 123 | 0111 1011 | 205 | 11001101 | 180 | 10110100 |
| 142 | 10001110 | 124 | 0111 1100 | 206 | 11001110 | 180 | 10110100 |
| 143 | 10001111 | 125 | 0111 1101 | 207 | 11001111 | 181 | 10110101 |
| 144 | 10010000 | 126 | 0111 1110 | 208 | 11010000 | 182 | 10110110 |
| 145 | 10010001 | 127 | 0111 1111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11011000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 1111 0000 | 210 | 11010010 |
| 177 | 10110001 | 155 | 10011011 | 241 | 1111 0001 | 211 | 11010011 |
| 178 | 10110010 | 156 | 10011100 | 242 | 1111 0010 | 212 | 11010100 |
| 179 | 10110011 | 157 | 10011101 | 243 | 1111 0011 | 213 | 11010101 |
| 180 | 10110100 | 158 | 10011110 | 244 | 1111 0100 | 214 | 11010110 |
| 181 | 10110101 | 158 | 10011110 | 245 | 1111 0101 | 215 | 11010111 |
| 182 | 10110110 | 159 | 10011111 | 246 | 1111 0110 | 216 | 11011000 |
| 183 | 10110111 | 160 | 10010000 | 247 | 1111 0111 | 216 | 11011000 |
| 184 | 10111000 | 161 | 10100001 | 248 | 1111 1000 | 217 | 11011001 |
| 185 | 10111001 | 162 | 10100010 | 249 | 1111 1001 | 218 | 11011010 |
| 186 | 10111010 | 163 | 10100011 | 250 | 1111 1010 | 219 | 11011011 |
| 187 | 10111011 | 164 | 10100100 | 251 | 1111 1011 | 220 | 11011100 |
| 188 | 10111100 | 165 | 10100101 | 252 | 1111 1100 | 221 | 11011101 |
| 189 | 10111101 | 166 | 10100110 | 253 | 1111 1101 | 222 | 11011110 |
| 190 | 10111110 | 166 | 10100110 | 254 | 1111 1110 | 223 | 11011111 |
| 191 | 10111111 | 167 | 10100111 | 255 | 1111 1111 | 224 | 11100000 |

FIG. 22

SELECTIVE ERASING

| Ds | HD 1 | 2 | 3 | 4 | 5 | 6 | 7 | 8 | 9 | 10 | 11 | 12 | 13 | 14 | LIGHT-EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT-EMISSION BRIGHTNESS |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 24

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 8 | BRIGHT-NESS | 0 ~ 7 | BRIGHT-NESS | 0 ~ 8 |
| 0 | 00000000 | 0 | 000000000 | 64 | 01000000 | 88 | 001011000 |
| 1 | 00000001 | 1 | 000000001 | 65 | 01000001 | 89 | 001011001 |
| 2 | 00000010 | 2 | 000000010 | 66 | 01000010 | 91 | 001011011 |
| 3 | 00000011 | 3 | 000000011 | 67 | 01000011 | 92 | 001011100 |
| 4 | 00000100 | 4 | 000000100 | 68 | 01000100 | 93 | 001011101 |
| 5 | 00000101 | 5 | 000000101 | 69 | 01000101 | 95 | 001011111 |
| 6 | 00000110 | 6 | 000000110 | 70 | 01000110 | 96 | 001100000 |
| 7 | 00000111 | 8 | 000001000 | 71 | 01000111 | 98 | 001100010 |
| 8 | 00001000 | 9 | 000001001 | 72 | 01001000 | 99 | 001100011 |
| 9 | 00001001 | 11 | 000001011 | 73 | 01001001 | 100 | 001100100 |
| 10 | 00001010 | 12 | 000001100 | 74 | 01001010 | 102 | 001100110 |
| 11 | 00001011 | 13 | 000001101 | 75 | 01001011 | 103 | 001100111 |
| 12 | 00001100 | 15 | 000001111 | 76 | 01001100 | 104 | 001101000 |
| 13 | 00001101 | 16 | 000010000 | 77 | 01001101 | 106 | 001101010 |
| 14 | 00001110 | 17 | 000010001 | 78 | 01001110 | 107 | 001101011 |
| 15 | 00001111 | 19 | 000010011 | 79 | 01001111 | 109 | 001101101 |
| 16 | 00010000 | 20 | 000010100 | 80 | 01010000 | 110 | 001101110 |
| 17 | 00010001 | 22 | 000010110 | 81 | 01010001 | 111 | 001101111 |
| 18 | 00010010 | 23 | 000010111 | 82 | 01010010 | 113 | 001110001 |
| 19 | 00010011 | 24 | 000011000 | 83 | 01010011 | 114 | 001110010 |
| 20 | 00010100 | 26 | 000011010 | 84 | 01010100 | 115 | 001110011 |
| 21 | 00010101 | 27 | 000011011 | 85 | 01010101 | 117 | 001110101 |
| 22 | 00010110 | 28 | 000011100 | 86 | 01010110 | 118 | 001110110 |
| 23 | 00010111 | 30 | 000011110 | 87 | 01010111 | 120 | 001111000 |
| 24 | 00011000 | 31 | 000011111 | 88 | 01011000 | 121 | 001111001 |
| 25 | 00011001 | 33 | 000100001 | 89 | 01011001 | 122 | 001111010 |
| 26 | 00011010 | 34 | 000100010 | 90 | 01011010 | 124 | 001111100 |
| 27 | 00011011 | 35 | 000100011 | 91 | 01011011 | 125 | 001111101 |
| 28 | 00011100 | 36 | 000100100 | 92 | 01011100 | 126 | 001111110 |
| 29 | 00011101 | 36 | 000100100 | 93 | 01011101 | 128 | 010000000 |
| 30 | 00011110 | 37 | 000100101 | 94 | 01011110 | 129 | 010000001 |
| 31 | 00011111 | 38 | 000100110 | 95 | 01011111 | 131 | 010000011 |
| 32 | 00100000 | 40 | 000101000 | 96 | 01100000 | 132 | 010000100 |
| 33 | 00100001 | 41 | 000101001 | 97 | 01100001 | 133 | 010000101 |
| 34 | 00100010 | 42 | 000101010 | 98 | 01100010 | 135 | 010000111 |
| 35 | 00100011 | 44 | 000101100 | 99 | 01100011 | 136 | 010001000 |
| 36 | 00100100 | 45 | 000101101 | 100 | 01100100 | 138 | 010001010 |
| 37 | 00100101 | 46 | 000101110 | 101 | 01100101 | 139 | 010001011 |
| 38 | 00100110 | 48 | 000110000 | 102 | 01100110 | 140 | 010001100 |
| 39 | 00100111 | 49 | 000110001 | 103 | 01100111 | 142 | 010001110 |
| 40 | 00101000 | 50 | 000110010 | 104 | 01101000 | 143 | 010001111 |
| 41 | 00101001 | 51 | 000110011 | 105 | 01101001 | 144 | 010010000 |
| 42 | 00101010 | 52 | 000110100 | 106 | 01101010 | 146 | 010010010 |
| 43 | 00101011 | 53 | 000110101 | 107 | 01101011 | 147 | 010010011 |
| 44 | 00101100 | 55 | 000110111 | 108 | 01101100 | 149 | 010010101 |
| 45 | 00101101 | 56 | 000111000 | 109 | 01101101 | 150 | 010010110 |
| 46 | 00101110 | 57 | 000111001 | 110 | 01101110 | 151 | 010010111 |
| 47 | 00101111 | 59 | 000111011 | 111 | 01101111 | 153 | 010011001 |
| 48 | 00110000 | 60 | 000111100 | 112 | 01110000 | 154 | 010011010 |
| 49 | 00110001 | 62 | 000111110 | 113 | 01110001 | 155 | 010011011 |
| 50 | 00110010 | 63 | 000111111 | 114 | 01110010 | 157 | 010011101 |
| 51 | 00110011 | 64 | 001000000 | 115 | 01110011 | 158 | 010001110 |
| 52 | 00110100 | 66 | 001000010 | 116 | 01110100 | 160 | 010100000 |
| 53 | 00110101 | 67 | 001000011 | 117 | 01110101 | 161 | 010100001 |
| 54 | 00110110 | 69 | 001000101 | 118 | 01110110 | 162 | 010100010 |
| 55 | 00110111 | 70 | 001000110 | 119 | 01110111 | 164 | 010100100 |
| 56 | 00111000 | 71 | 001000111 | 120 | 01111000 | 165 | 010100101 |
| 57 | 00111001 | 73 | 001001001 | 121 | 01111001 | 167 | 010100111 |
| 58 | 00111010 | 74 | 001001010 | 122 | 01111010 | 168 | 010101000 |
| 59 | 00111011 | 75 | 001001011 | 123 | 01111011 | 169 | 010101001 |
| 60 | 00111100 | 77 | 001001101 | 124 | 01111100 | 171 | 010101011 |
| 61 | 00111101 | 78 | 001001110 | 125 | 01111101 | 172 | 010101100 |
| 62 | 00111110 | 80 | 001010000 | 126 | 01111110 | 173 | 010101101 |
| 63 | 00111111 | 81 | 001010001 | 127 | 01111111 | 175 | 010101111 |

FIG. 25

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 8 | BRIGHT-NESS | 0 ~ 7 | BRIGHT-NESS | 0 ~ 8 |
| 128 | 10000000 | 176 | 010110000 | 192 | 11000000 | 265 | 100001001 |
| 129 | 10000001 | 178 | 010110010 | 193 | 11000001 | 266 | 100001010 |
| 130 | 10000010 | 179 | 010110011 | 194 | 11000010 | 267 | 100001011 |
| 131 | 10000011 | 180 | 010110100 | 195 | 11000011 | 269 | 100001101 |
| 132 | 10000100 | 182 | 010110110 | 196 | 11000100 | 270 | 100001110 |
| 133 | 10000101 | 183 | 010110111 | 197 | 11000101 | 271 | 100001111 |
| 134 | 10000110 | 184 | 010111000 | 198 | 11000110 | 273 | 100010001 |
| 135 | 10000111 | 186 | 010111010 | 199 | 11000111 | 274 | 100010010 |
| 136 | 10001000 | 187 | 010111011 | 200 | 11001000 | 276 | 100010100 |
| 137 | 10001001 | 189 | 010111101 | 201 | 11001001 | 277 | 100010101 |
| 138 | 10001010 | 190 | 010111110 | 202 | 11001010 | 278 | 100010110 |
| 139 | 10001011 | 191 | 010111111 | 203 | 11001011 | 280 | 100011000 |
| 140 | 10001100 | 193 | 011000001 | 204 | 11001100 | 281 | 100011001 |
| 141 | 10001101 | 194 | 011000010 | 205 | 11001101 | 282 | 100011010 |
| 142 | 10001110 | 196 | 011000100 | 206 | 11001110 | 284 | 100011100 |
| 143 | 10001111 | 197 | 011000101 | 207 | 11001111 | 285 | 100011101 |
| 144 | 10010000 | 198 | 011000110 | 208 | 11010000 | 287 | 100011111 |
| 145 | 10010001 | 200 | 011001000 | 209 | 11010001 | 288 | 100100000 |
| 146 | 10010010 | 201 | 011001001 | 210 | 11010010 | 289 | 100100001 |
| 147 | 10010011 | 202 | 011001010 | 211 | 11010011 | 291 | 100100011 |
| 148 | 10010100 | 204 | 011001100 | 212 | 11010100 | 292 | 100100100 |
| 149 | 10010101 | 205 | 011001101 | 213 | 11010101 | 294 | 100100110 |
| 150 | 10010110 | 207 | 011001111 | 214 | 11010110 | 295 | 100100111 |
| 151 | 10010111 | 208 | 011010000 | 215 | 11010111 | 296 | 100101000 |
| 152 | 10011000 | 209 | 011010001 | 216 | 11011000 | 298 | 100101010 |
| 153 | 10011001 | 211 | 011010011 | 217 | 11011001 | 299 | 100101011 |
| 154 | 10011010 | 212 | 011010100 | 218 | 11011010 | 300 | 100101100 |
| 155 | 10011011 | 213 | 011010101 | 219 | 11011011 | 302 | 100101110 |
| 156 | 10011100 | 215 | 011010111 | 220 | 11011100 | 303 | 100101111 |
| 157 | 10011101 | 216 | 011011001 | 221 | 11011101 | 305 | 100110001 |
| 158 | 10011110 | 218 | 011011010 | 222 | 11011110 | 306 | 100110010 |
| 159 | 10011111 | 219 | 011011011 | 223 | 11011111 | 307 | 100110011 |
| 160 | 10100000 | 220 | 011011100 | 224 | 11100000 | 309 | 100110101 |
| 161 | 10100001 | 222 | 011011110 | 225 | 11100001 | 310 | 100110110 |
| 162 | 10100010 | 223 | 011011111 | 226 | 11100010 | 311 | 100110111 |
| 163 | 10100011 | 225 | 011100001 | 227 | 11100011 | 313 | 100111001 |
| 164 | 10100100 | 226 | 011100010 | 228 | 11100100 | 314 | 100111010 |
| 165 | 10100101 | 227 | 011100011 | 229 | 11100101 | 316 | 100111100 |
| 166 | 10100110 | 229 | 011100101 | 230 | 11100110 | 317 | 100111101 |
| 167 | 10100111 | 230 | 011100110 | 231 | 11100111 | 318 | 100111110 |
| 168 | 10101000 | 231 | 011100111 | 232 | 11101000 | 320 | 101000000 |
| 169 | 10101001 | 233 | 011101001 | 233 | 11101001 | 321 | 101000001 |
| 170 | 10101010 | 234 | 011101010 | 234 | 11101010 | 323 | 101000011 |
| 171 | 10101011 | 236 | 011101100 | 235 | 11101011 | 324 | 101000100 |
| 172 | 10101100 | 237 | 011101101 | 236 | 11101100 | 325 | 101000101 |
| 173 | 10101101 | 238 | 011101110 | 237 | 11101101 | 327 | 101000111 |
| 174 | 10101110 | 240 | 011110000 | 238 | 11101110 | 328 | 101001000 |
| 175 | 10101111 | 241 | 011110001 | 239 | 11101111 | 329 | 101001001 |
| 176 | 10110000 | 242 | 011110010 | 240 | 11110000 | 331 | 101001011 |
| 177 | 10110001 | 244 | 011110100 | 241 | 11110001 | 332 | 101001100 |
| 178 | 10110010 | 245 | 011110101 | 242 | 11110010 | 334 | 101001110 |
| 179 | 10110011 | 247 | 011110111 | 243 | 11110011 | 335 | 101001111 |
| 180 | 10110100 | 248 | 011111000 | 244 | 11110100 | 336 | 101010000 |
| 181 | 10110101 | 249 | 011111001 | 245 | 11110101 | 338 | 101010010 |
| 182 | 10110110 | 251 | 011111011 | 246 | 11110110 | 339 | 101010011 |
| 183 | 10110111 | 252 | 011111100 | 247 | 11110111 | 340 | 101010100 |
| 184 | 10111000 | 253 | 011111101 | 248 | 11111000 | 342 | 101010110 |
| 185 | 10111001 | 255 | 011111111 | 249 | 11111001 | 343 | 101010111 |
| 186 | 10111010 | 256 | 100000000 | 250 | 11111010 | 345 | 101011001 |
| 187 | 10111011 | 258 | 100000010 | 251 | 11111011 | 346 | 101011010 |
| 188 | 10111100 | 259 | 100000011 | 252 | 11111100 | 347 | 101011011 |
| 189 | 10111101 | 260 | 100000100 | 253 | 11111101 | 349 | 101011101 |
| 190 | 10111110 | 262 | 100000110 | 254 | 11111110 | 350 | 101011110 |
| 191 | 10111111 | 263 | 100000111 | 255 | 11111111 | 352 | 101100000 |

FIG. 26

SELECTIVE ERASING

| Ds | HD | | | | | | | | | | | | | | LIGHT-EMISSION DRIVE PATTERN IN ONE FIELD | | | | | | | | | | | | | | LIGHT-EMISSION BRIGHTNESS |
|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 00000 | 1 | 0 | 0 | 0 | 0 | 0 | 1 | 0 | 0 | 0 | 0 | 0 | 0 | 0 | ● | | | | | | ● | | | | | | | | 0 |
| 00001 | 0 | 1 | 0 | 0 | 0 | 0 | 1 | 0 | 0 | 0 | 0 | 0 | 0 | 0 | ○ | ● | | | | | ● | | | | | | | | 1 |
| 00010 | 0 | 0 | 1 | 0 | 0 | 0 | 1 | 0 | 0 | 0 | 0 | 0 | 0 | 0 | ○ | ○ | ● | | | | ● | | | | | | | | 2 |
| 00011 | 0 | 0 | 0 | 1 | 0 | 0 | 1 | 0 | 0 | 0 | 0 | 0 | 0 | 0 | ○ | ○ | ○ | ● | | | ● | | | | | | | | 3 |
| 00100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 6 |
| 00101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 9 |
| 00110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 17 |
| 00111 | 0 | 0 | 0 | 0 | 0 | 1 | 0 | 1 | 0 | 0 | 0 | 0 | 0 | 0 | ○ | ○ | ○ | ○ | ○ | ● | ○ | ● | | | | | | | 22 |
| 01000 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 30 |
| 01001 | 0 | 0 | 0 | 0 | 0 | 1 | 0 | 0 | 1 | 0 | 0 | 0 | 0 | 0 | ○ | ○ | ○ | ○ | ○ | ● | ○ | ○ | ● | | | | | | 37 |
| 01010 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 45 |
| 01011 | 0 | 0 | 0 | 0 | 0 | 1 | 0 | 0 | 0 | 1 | 0 | 0 | 0 | 0 | ○ | ○ | ○ | ○ | ○ | ● | ○ | ○ | ○ | ● | | | | | 57 |
| 01100 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 65 |
| 01101 | 0 | 0 | 0 | 0 | 0 | 1 | 0 | 0 | 0 | 0 | 1 | 0 | 0 | 0 | ○ | ○ | ○ | ○ | ○ | ● | ○ | ○ | ○ | ○ | ● | | | | 82 |
| 01110 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 90 |
| 01111 | 0 | 0 | 0 | 0 | 0 | 1 | 0 | 0 | 0 | 0 | 0 | 1 | 0 | 0 | ○ | ○ | ○ | ○ | ○ | ● | ○ | ○ | ○ | ○ | ○ | ● | | | 113 |
| 10000 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 121 |
| 10001 | 0 | 0 | 0 | 0 | 0 | 1 | 0 | 0 | 0 | 0 | 0 | 0 | 1 | 0 | ○ | ○ | ○ | ○ | ○ | ● | ○ | ○ | ○ | ○ | ○ | ○ | ● | | 150 |
| 10010 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 158 |
| 10011 | 0 | 0 | 0 | 0 | 1 | 0 | 0 | 0 | 0 | 0 | 0 | 0 | 0 | 1 | ○ | ○ | ○ | ○ | ● | ○ | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 0 | 0 | 0 | 0 | 0 | 0 | 0 | 0 | 0 | ○ | ○ | ○ | ○ | ● | ○ | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 27

SELECTIVE ERASING

| Ds | HD 1 | 2 | 3 | 4 | 5 | 6 | 7 | 8 | 9 | 10 | 11 | 12 | 13 | 14 | LIGHT-EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT-EMISSION BRIGHTNESS |
|---|---|---|---|---|---|---|---|---|---|---|---|---|---|---|---|---|---|---|---|---|---|---|---|---|---|---|---|---|---|
| 0000 | 1 | 1 | 0 | 0 | 0 | 0 | 0 | 0 | 0 | 0 | 0 | 0 | 0 | 0 | ● | ● | | | | | | | | | | | | | 0 |
| 0001 | 0 | 1 | 1 | 0 | 0 | 0 | 0 | 0 | 0 | 0 | 0 | 0 | 0 | 0 | ○ | ● | ● | | | | | | | | | | | | 1 |
| 0010 | 0 | 0 | 1 | 1 | 0 | 0 | 0 | 0 | 0 | 0 | 0 | 0 | 0 | 0 | ○ | ○ | ● | ● | | | | | | | | | | | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 28

SELECTIVE ERASING

| Ds | HD 1 | 2 | 3 | 4 | 5 | 6 | 7 | 8 | 9 | 10 | 11 | 12 | 13 | 14 | LIGHT-EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT-EMISSION BRIGHTNESS |
|---|---|---|---|---|---|---|---|---|---|---|---|---|---|---|---|---|---|---|---|---|---|---|---|---|---|---|---|---|---|
| 0000 | 1 | 0 | 1 | 0 | 0 | 0 | 0 | 0 | 0 | 0 | 0 | 0 | 0 | 0 | ● | | ● | | | | | | | | | | | | 0 |
| 0001 | 0 | 1 | 0 | 1 | 0 | 0 | 0 | 0 | 0 | 0 | 0 | 0 | 0 | 0 | ○ | ● | | ● | | | | | | | | | | | 1 |
| 0010 | 0 | 0 | 1 | 0 | 1 | 0 | 0 | 0 | 0 | 0 | 0 | 0 | 0 | 0 | ○ | ○ | ● | | ● | | | | | | | | | | 4 |
| 0011 | 0 | 0 | 0 | 1 | 0 | 1 | 0 | 0 | 0 | 0 | 0 | 0 | 0 | 0 | ○ | ○ | ○ | ● | | ● | | | | | | | | | 9 |
| 0100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 17 |
| 0101 | 0 | 0 | 0 | 0 | 0 | 1 | 0 | 1 | 0 | 0 | 0 | 0 | 0 | 0 | ○ | ○ | ○ | ○ | ○ | ● | | ● | | | | | | | 27 |
| 0110 | 0 | 0 | 0 | 0 | 0 | 0 | 1 | 0 | 1 | 0 | 0 | 0 | 0 | 0 | ○ | ○ | ○ | ○ | ○ | ○ | ● | | ● | | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ● | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ● | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ● | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ● | | ● | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ● | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 29

SELECTIVE ERASING

| Ds | HD 1 | 2 | 3 | 4 | 5 | 6 | 7 | 8 | 9 | 10 | 11 | 12 | 13 | 14 | LIGHT-EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT-EMISSION BRIGHTNESS |
|---|---|---|---|---|---|---|---|---|---|---|---|---|---|---|---|---|---|---|---|---|---|---|---|---|---|---|---|---|---|
| 0000 | 1 | 1 | * | * | * | * | * | * | * | * | * | * | * | * | ● | ● | △ | △ | △ | △ | △ | △ | △ | △ | △ | △ | △ | △ | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 17 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

FIG. 30

SELECTIVE ERASING

| Ds | HD | | | | | | | | | | | | | | LIGHT-EMISSION DRIVE PATTERN IN ONE FIELD | | | | | | | | | | | | | | LIGHT-EMISSION BRIGHTNESS |
|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 00000 | 1 | 1 | 0 | 0 | 0 | 0 | 1 | 1 | 0 | 0 | 0 | 0 | 0 | 0 | ● | ● | | | | | ● | ● | | | | | | | 0 |
| 00001 | 0 | 1 | 1 | 0 | 0 | 0 | 1 | 1 | 0 | 0 | 0 | 0 | 0 | 0 | ○ | ● | ● | | | | ● | ● | | | | | | | 1 |
| 00010 | 0 | 0 | 1 | 1 | 0 | 0 | 1 | 1 | 0 | 0 | 0 | 0 | 0 | 0 | ○ | ○ | ● | ● | | | ● | ● | | | | | | | 2 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | 3 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECT-ERASING DISCHARGE
WHITE CIRCLE : LIGHT-EMISSION

METHOD FOR DRIVING A PLASMA DISPLAY PANEL

BACKGROUND OF THE INVENTION

1. Field of the Invention

The present invention relates to a method for driving a plasma display panel (hereinafter designated "PDP") which employs a matrix display scheme.

2. Description of Related Art

As a type of PDP employing such a matrix display scheme, known is an AC (alternating current discharge) type PDP.

The AC type PDP comprises a plurality of column electrodes (address electrodes) and a plurality of row electrodes, orthogonal to the column electrodes, and a pair of row electrodes forming a scan line. Each of these row and column electrodes is coated with a dielectric layer exposed to a discharge space, and an intersection of a row electrode and a column electrode define a discharge cell corresponding to one pixel.

With this construction, PDP operates by discharge phenomenon and thus the aforementioned discharge cell has only two states, that is, a "light-emitting" state and a "non-light-emitting" state. Accordingly, in order to implement brightness display of halftone with such a PDP, a sub-field method is employed. According to the sub-field method, the period of one field is divided into N sub-fields and each of the sub-fields is assigned with a light emitting period (the number of light emissions) corresponding to the weight assigned to each bit digit of pixel data (N bits) for light-emission.

For example, as shown in FIG. 1, in the case where one field period is divided into 6 sub-fields, SF1 through SF6, light is emitted with the following ratio of light emission periods. That is,

SF1: 1
SF2: 2
SF3: 4
SF4: 8
SF5: 16
SF6: 32

For example, when the discharge cell is to emit light at brightness "32", only SF6 of sub-fields SF1 through SF6 is allowed for emitting light. For light emission at brightness "31", sub-fields SF1 through SF5, except for sub-field SF6, are caused to emit light. This enables brightness expression with 64 levels of halftone.

In cases where the discharge cells are caused to emit light at brightness "32" and at "31", light emission drive patterns are inverse with each other in one field period. That is, within one field period, during the period when the discharge cells that are to emit light at brightness "32" are emitting light, the discharge cells that are to emit light at brightness "31" are in a "non-light-emitting" state. On the other hand, during the period when the discharge cells that are to emit light at brightness "31" are emitting light, the discharge cells that are to emit light at brightness "32" are in a "non-light-emitting" state.

Therefore, presence of a region where a cell that is to emit light at brightness "32" is adjacent to a cell that is to emit light at brightness "31" may cause a quasi-contour to be noticed in this region. That is, suppose that line of sight from the cell that is to emit light at brightness "32", immediately before the cell changes from the non-light-emitting state to the light-emitting state, is moved to the cell that is to emit light at brightness "31". In this case, only the non-light-emitting state of both cells is continuously viewed, thereby causing a dark line to be viewed on the boundary of both. Therefore, this dark line appears on the screen as a quasi-contour that has nothing to do with pixel data, thereby degrading the display quality.

Furthermore, as mentioned above, PDP employs discharge phenomenon and thus discharge (accompanying light emission) which has nothing to do with the contents of the display being be performed. This also presented a problem in that the contrast of picture images is degraded. Still furthermore, at present, there is a general theme of implementing low power consumption in manufacturing such PDP.

OBJECT AND SUMMARY OF THE INVENTION

The present invention has been developed to solve the aforementioned problems. Its object is to provide a method for driving a plasma display panel that can provide improved contrast at low power consumption while preventing quasi contours, and improved display quality by stabilizing selection discharge.

The method for driving a plasma display panel, according to a first aspect of the present invention, is characterized in that the plasma display panel comprises pairs of row electrodes arrayed for each scan line and a plurality of column electrodes arrayed intersecting the respective row electrodes, wherein respective discharge cells are formed corresponding to respective pixels at respective intersections of pairs of the row electrodes for the respective scan lines and the plurality of column electrodes and wherein N sub-fields form a display period of one field, with M ($2 \leqq M \leqq N$) sub-fields occurring successively within the N sub-fields being taken as a sub-field group; executed are a reset process for generating discharge for initializing all the discharge cells into a light-emitting cell state only in the head sub-field in the sub-field group, a pixel data write process for applying pixel data pulses to the column electrodes for generating discharge to set the discharge cells to non-light-emitting cells in any one of the sub-fields within the one field and for applying scan pulses to one of the pair of row electrodes in synchronization with the pixel data pulses, and a light-emission sustain process for generating discharge for causing only the light-emitting cells to emit light only for a light-emission period corresponding to a weight of the sub-field in respective sub-fields within the sub-field groups; and sub-fields of a plurality of sub-groups classified according to waveforms of the scan pluses of respective sub-fields exist in said sub-field group and at least one of the pulse widths and pulse voltages of the scan pulses within sub-fields belonging to a first sub-group including at least a head sub-field of the sub-field group is set larger than respective values of the same of the scan pluses within a sub-field belonging to another sub-group.

The method for driving a plasma display panel, according to a second aspect of the present invention, is characterized in that the plasma display panel comprises pairs of row electrodes arrayed for each scan line and a plurality of column electrodes arrayed intersecting the respective row electrodes, wherein respective discharge cells are formed corresponding to respective pixels at respective intersections of pairs of the row electrodes for the respective scan lines and the plurality of column electrodes, and wherein N (N is an integer equal to 2 or more) sub-fields form a display period of one field; executed are a reset process for generating discharge for initializing all the discharge cells into a light-emitting cell state only in the head sub-field in the one field, a pixel data write process for applying pixel data pulses to the column electrodes for generating discharge to set the discharge cells to non-light-emitting cells in any one of the sub-fields within the one field and for applying scan pulses to one of the pair of row electrodes in synchronization with the pixel data pulses, and a light-emission sustain process for applying sustain pulses to the row electrodes alternately and sequentially in order to generate discharge for causing only the light-emitting cells to emit light only for a light-emission period corresponding to a weight of the sub-field in respective sub-fields within the one field; and at least one of the pulse widths and pulse voltages of the sustain pulse to be applied finally at the light-emission sustaining process is set larger than the pulse width and pulse voltage of the sustain pulse to be applied at some midpoint in the same light-emission sustaining process.

The method for driving a plasma display panel, according to a third aspect of the present invention, is characterized in that the plasma display panel comprises pairs of row electrodes arrayed for each scan line and a plurality of column electrodes arrayed intersecting the respective row electrodes, wherein respective discharge cells are formed corresponding to respective pixels at respective intersections of pairs of the row electrodes for the respective scan lines and the plurality of column electrodes, and wherein N (N is an integer equal to 2 or more) sub-fields form a display period of one field into, with M (2_ . . . M_ . . . N) sub-fields occurring successively within the N sub-fields being taken as a sub-field group; executed are a reset process for generating discharge for initializing all the discharge cells into a light-emitting cell state only in the head sub-field in the sub-field group, a pixel data write process for applying pixel data pulses to the column electrodes for generating discharge to set the discharge cells to non-light-emitting cells in any one of the sub-fields within the sub-field group and for applying scan pulses to one of the pair of row electrodes in synchronization with the pixel data pulses, and a light-emission sustain process for applying sustain pulses to the row electrodes alternately and sequentially in order to generate discharge for causing only the light-emitting cells to emit light only for a light-emission period corresponding to a weight of the sub-field in respective sub-fields within the sub-field group; and at least one of the pulse widths and pulse voltages of the sustain pulse to be applied finally at respective light-emission sustaining processes in the sub-field group is set larger than the pulse widths and pulse voltages of the sustain pulse to be applied at some midpoint in the same light-emission sustaining process.

BRIEF DESCRIPTION OF THE DRAWINGS

FIG. 6 is a view showing an example of a pattern of light-emission drive to be performed in accordance with the light-emission drive format shown in FIG. 3;

FIG. 14 is a view showing the relationship between the brightness mode and the period of light-emission performed during light-emission sustaining process at each sub-field;

FIG. 16 is a view showing an example of a conversion table of the first data conversion circuit 32;

FIG. 17 is a view showing an example of a conversion table of the first data conversion circuit 32;

FIG. 22 is a view showing all patterns of light-emission drive to be performed in accordance with the light-emission drive format shown in FIG. 3 and an example of a conversion table to be used by the second data conversion circuit 34 for performing this light-emission drive;

FIG. 24 is a view showing an example of a conversion table to be used by the first data conversion circuit 32 for performing light-emission drive in accordance with the light-emission drive format shown in FIG. 23;

FIG. 25 is a view showing an example of a conversion table to be used by the first data conversion circuit 32 for performing light-emission drive in accordance with the light-emission drive format shown in FIG. 23;

FIG. 26 is a view showing all patterns of light-emission drive to be performed in accordance with the light-emission drive format shown in FIG. 23 and an example of a conversion table to be used by the second data conversion circuit 34 for performing this light-emission drive;

FIG. 27 is a view showing a light-emission drive pattern in accordance with the drive method of the present invention;

FIG. 28 is a view showing another example of a light-emission drive pattern in accordance with the drive method of the present invention;

FIG. 29 is a view showing another example of a light-emission drive pattern in accordance with the drive method of the present invention; and FIG. 30 is a view showing another example of a light-emission drive pattern in accordance with the drive method of the present invention.

DETAILED DESCRIPTION OF THE PREFERRED EMBODIMENTS

The embodiments of the present invention will be explained in detail below with reference to the drawings.

Figure 1:
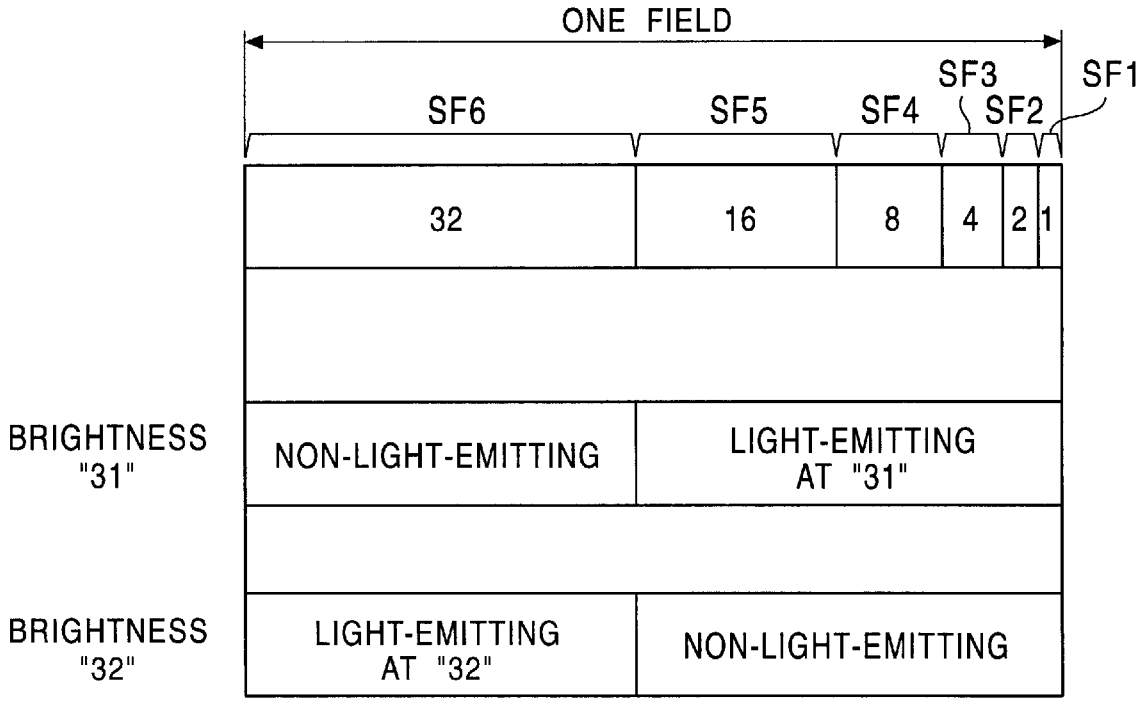
FIG. 1 is a view showing a conventional light-emission drive format for implementing display with 64 levels of halftone.
Figure 2:
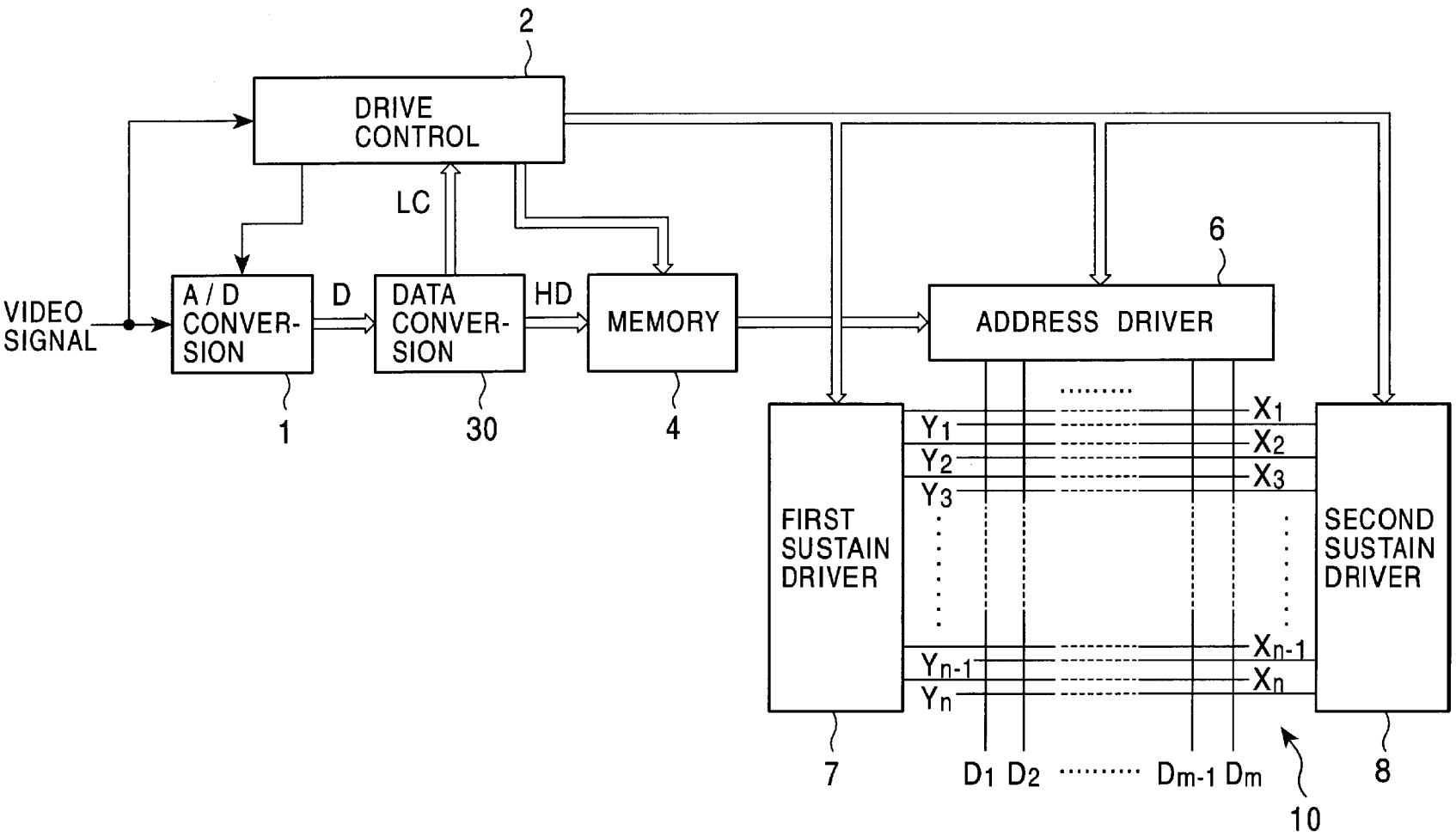
FIG. 2 is a view showing the configuration in outline of a plasma display device for driving a plasma display panel in accordance with the drive method of the present invention.

FIG. 2 is a view showing the configuration in outline of a plasma display device for driving a plasma display panel (hereinafter designated "PDP") to allow it to emit light in accordance with the drive method of the present invention.

In FIG. 2, the A/D converter 1 samples an analog input video signal in response to a clock signal supplied by the drive control circuit 2 to convert the video signal into, for example, 8-bit pixel data (input pixel data) D for each pixel. Then the data is supplied to the data conversion circuit 30.

The drive control circuit 2 generates clock signals for the aforementioned A/D converter 1 and write/read signals for the memory 4 in synchronization with the horizontal and vertical synchronizing signals included in the aforementioned input video signal. Furthermore, the drive control circuit 2 generates various timing signals for controllably driving each of address driver 6, the first sustain driver 7, and the second sustain driver 8 in synchronization with the horizontal and vertical synchronizing signals.

The data conversion circuit 30 converts the 8-bit pixel data D into 14-bit converted pixel data (display pixel data) HD which is in turn supplied to the memory 4. Incidentally, the conversion operation of the data conversion circuit 30 is to be described later.

The memory 4 writes sequentially the converted pixel data HD mentioned above in accordance with write signals supplied by the drive control circuit 2. Upon completion of writing data for one screen (n rows and m columns) through the write operation, the memory 4 reads the converted pixel data $HD_{11\text{-}nm}$ for one screen by dividing them into each bit digit which is in turn supplied sequentially to address driver 6 for each one line.

The address driver 6 generates, in accordance with the timing signal supplied by the drive control circuit 2, m pulses of pixel data having voltages corresponding to respective logic levels of the converted pixel data bits for a line which are read from the memory 4. These are applied to column electrodes $D_1$ to $D_m$ of PDP 10, respectively.

The PDP 10 comprises the aforementioned column electrodes $D_1$ to $D_m$ as address electrodes, and row electrodes $X_1$ to $X_n$ and row electrodes $Y_1$ to $Y_n$, which are disposed orthogonal to the column electrodes. In the PDP 10, a pair of a row electrode X and a row electrode Y forms a row electrode corresponding to one line. That is, in the PDP 10, the row electrode pair of the first line consists of row electrodes $X_1$ and $Y_1$ and the row electrode pair of the nth line consists of row electrodes $X_n$ and $Y_n$. The aforementioned pairs of row electrodes and column electrodes are coated with a dielectric layer exposed to a discharge space, and each row electrode pair and column electrode are configured so as to form a discharge cell corresponding to one pixel at their intersection.

In accordance with the timing signal supplied by the drive control circuit 2, the first and second sustain drivers 7 and 8 generate the various drive pulses respectively, which are to be explained below. The pulses are in turn applied to the row electrodes $X_1$ to $X_n$ and $Y_1$ to $Y_n$ of the PDP 10.

Figure 3:
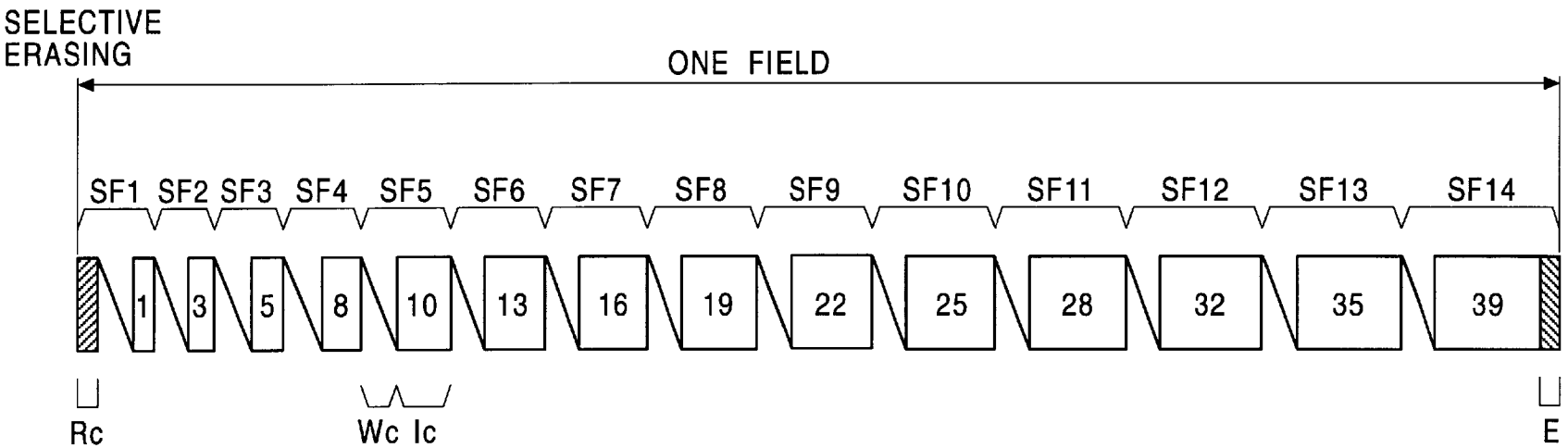
FIG. 3 is a view showing the light emission drive format employing a selective erasing drive method.
Figure 4:
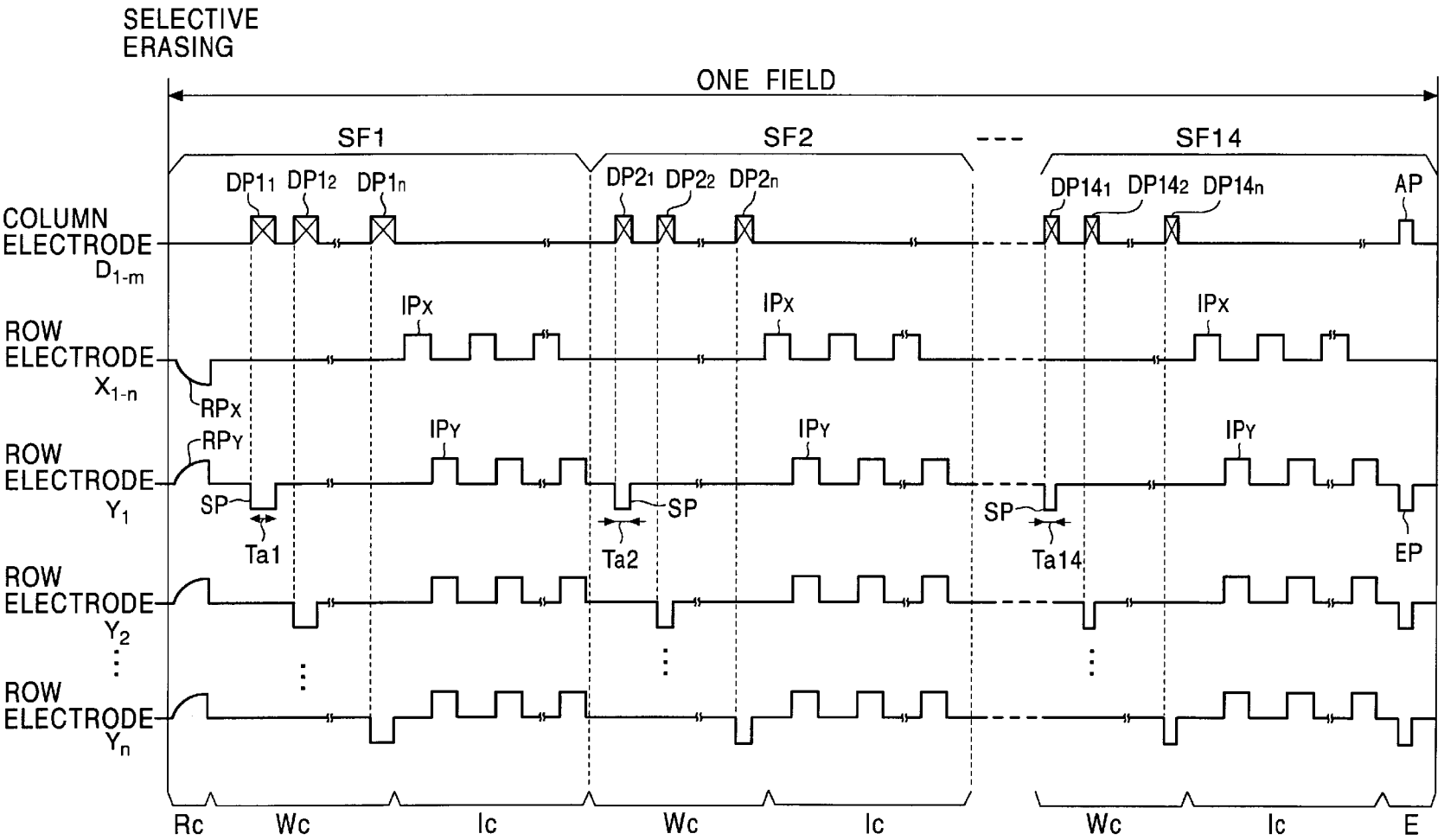
FIG. 4 is a view showing an example of application timing of various drive pulses to be applied to PDP 10.
Figure 5:
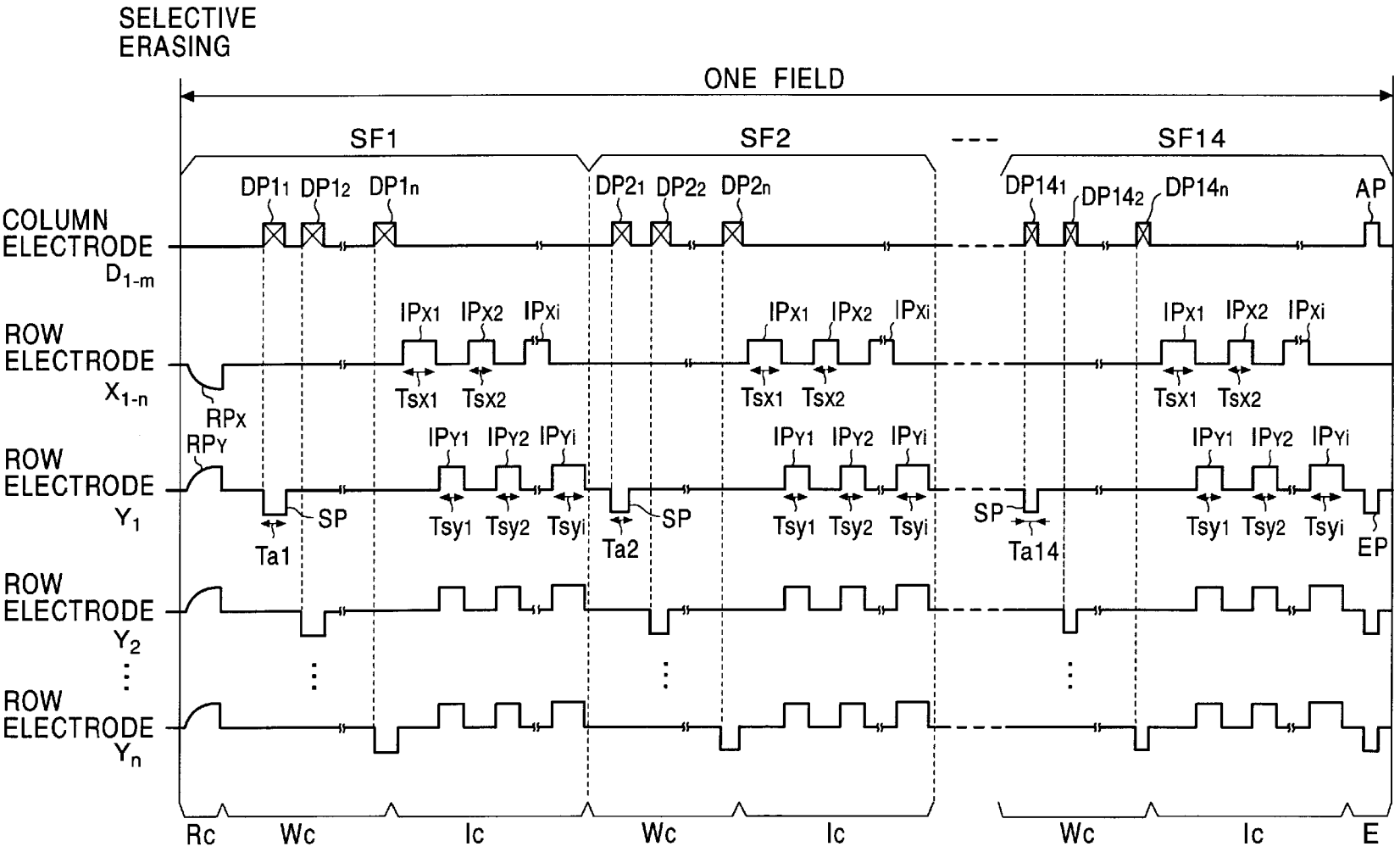
FIG. 5 is a view showing another example of application timing of various drive pulses to be applied to PDP 10.

FIG. 3 is a view showing the light emission drive format employing the drive method of the present invention. Additionally, FIG. 4 and FIG. 5 are views showing the application timing of various drive pulses. The pulses being applied by the aforementioned address driver 6 and the first and second sustain drivers 7 and 8 to the column electrodes $D_1$ to $D_m$ and row electrodes $X_1$ to $X_n$ and $Y_1$ to $Y_n$ of the PDP 10, respectively, in accordance with the light-emission drive format.

In the examples shown in FIG. 3, FIG. 4, and FIG. 5, a display period of one field is divided into 14 sub-fields SF1 through SF14 to drive the PDP 10. In each of the sub-fields, performed are the pixel data write process Wc for writing pixel data to each discharge cell of the PDP 10 for setting light-emitting and non-light-emitting cells and the light-emission sustain process Ic for sustaining light-emission of only the aforementioned light-emitting cells. Additionally, only in the head sub-field SF1, the simultaneous reset process Rc for initializing all discharge cells of the PDP 10 is performed and the erase process E is executed only in the last sub-field SF14.

In the foregoing, in the aforementioned simultaneous reset process Rc, the first and second sustain drivers 7 and 8 apply simultaneously the reset pulses $RP_x$ and $RP_y$ shown in FIG. 4 and FIG. 5 to the row electrodes $X_1$ to $X_n$ and $Y_1$ to $Y_n$ of the PDP 10, respectively. This will cause all discharge cells of the PDP 10 to be reset and discharge, forming a predetermined uniform wall charge in each of the discharge cells. This will turn all discharge cells of the PDP 10 to light-emitting cells that are sustained under the light-emission state at the light-emission sustain process, which is to be described later.

In each pixel data write process Wc, the address driver 6 applies sequentially pixel data pulse groups $DP1_{1\sim n}$, $DP2_{1\sim n}$, $DP3_{1\sim n}$, $DP14_{1\sim n}$, for respective lines to the column electrodes $D_1$ to $D_m$ as shown in FIG. 4 and FIG. 5. That is, in the sub-field SF1, the address driver 6 applies sequentially a pixel data pulse group $DP1_{1\sim n}$ to the column electrodes $D_1$ to $D_m$ for each one of the lines to the column electrodes $D_1$ to $D_m$ as shown in FIG. 4 and FIG. 5, said pixel data pulse group $DP1_{1\sim n}$ corresponding to each of the first to the nth line and being generated in accordance with the first bit of each of the aforementioned converted pixel data $HD_{11\text{-}nm}$. Moreover, in the sub-field SF2, the address driver 6 applies sequentially a pixel data pulse group $DP2_{1\sim n}$ to the column electrodes $D_1$ to $D_m$ for each one of the lines to the column electrodes $D_1$ to $D_m$ as shown in FIG. 4 and FIG. 5, said pixel data pulse group $DP2_{1\sim n}$ being generated in accordance with the second bit of each of the aforementioned converted pixel data $HD_{11\text{-}nm}$. At this time, the address driver 6 generates high-tension pixel data pulses to apply them to the column electrodes D only when the bit logic of the converted pixel data is, for example, a logic level of "1". The second sustain driver 8 generates the scan pulses SP shown in FIG. 4 and FIG. 5 to apply them in sequence to the row electrodes $Y_1$ to $Y_n$ at the same timing as the application timing of each of the pixel data pulse groups. At this time, discharge (selective erasing discharge) is caused only at the discharge cells located at the intersections of the "lines" to which the scan pulse SP is applied and the "columns" to which a high-tension pixel data pulse is applied. The wall charges remaining within the discharge cells are selectively erased. The selective erasing discharge causes the discharge cells that have been initialized into the light-emitting status at the aforementioned simultaneous reset process Rc to change to the non-light-emitting state.

Incidentally, no discharge is generated in the discharge cells that are formed in the "columns" to which the aforementioned high-tension pixel data pulse has not been applied but the state of being initialized at the aforementioned simultaneous reset process Rc, that is, light-emitting state is sustained.

That is, executing the pixel data write process Wc causes the light-emitting cells where the light-emitting state is sustained at the light-emitting sustain process which is to be described later and the non-light-emitting cells where an off state remains to be set alternatively in accordance with pixel data. That is, pixel data is written to each of the discharge cells.

The scan pulses SP are generated for each of the sub-fields SF1 through SF14 in the order of the row electrodes $Y_1$ to $Y_n$. The pulse width of the scan pulses SP is the largest in the sub-field SF1 and becomes smaller in subsequent sub-fields over time with the width being the smallest in the sub-field SF14. That is, as shown in FIG. 4 and FIG. 5, supposing that the pulse widths of the scan pulses SP corresponding to respective sub-fields SF1 through SF14 be Ta1 through Ta14, then the following relationship holds. Namely, $$Ta1>Ta2>Ta3>Ta4> \ldots >Ta12>Ta13>Ta14$$

Furthermore, FIG. 4 is also a view showing a first aspect of the present invention. Suppose that SF1 is the first group (sub-group) of the sub-field, SF2 the second group (second sub-group) of sub-field, SF3 the third group (third sub-group) of sub-field . . . SF14 the 14th group (14th sub-group) of sub-field. The pulse width of the scan pulses SP in the first group (first sub-group) of sub-field SF1, that is, the head sub-field, is set to be larger than that of any other scan pulses in the other groups (sub-groups) of sub-fields SF2 through SF14.

In each light-emission sustain process Ic, the first and second sustain drivers 7 and 8 apply the sustain pulses $IP_X$ and $IP_Y$ to the row electrodes $X_1$ to $X_n$ and $Y_1$ to $Y_n$ as shown in FIG. 4 and FIG. 5. At this time, there are discharge cells where wall charges remain by the aforementioned pixel data write process Wc, that is, the light-emitting cells repeat discharge and light-emission to sustain their light-emitting states over the period of application of the sustain pulses $IP_X$ and $IP_Y$ thereto. Incidentally, the sustain periods of light-emission performed at such light-emission sustain process Ic are different depending on each sub-field as shown in FIG. 3.

That is, when the light-emitting period is equal to "1" at the light-emission sustain process Ic of the sub-field SF1, the other sub-fields are set as follows:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

That is, the ratios of the number of light-emissions of respective sub-fields SF1 through SF14 are set so as to be non-linear (i.e., inverse Gamma ratio, $Y=X^{2.2}$). This is to compensate for the non-linear characteristics (Gamma characteristics) of input pixel data D.

In the example shown in FIG. 5, the pulse width $T_{SX1}$ of the sustain pulse $IP_{X1}$ which is applied first to the row electrodes $X_1$ to $X_n$ in each of the sub-fields SF1 through SF14 is made larger than any pulse widths $T_{SX2}$ to $T_{Sxi}$ of the subsequent sustain pulses $IP_{X2}$ to $IP_{Xi}$. Moreover, the pulse width $T_{SYi}$ of the sustain pulse $IP_{Yi}$ which is applied finally to the row electrodes $Y_1$ to $Y_n$ in each of the sub-fields SF1 through SF14 is made larger than any pulse widths $T_{SY1}$ to $T_{Syi-1}$ of the previous sustain pulses $IP_{Y1}$ to $IP_{Yi-1}$.

Furthermore, as shown in FIG. 4 and FIG. 5, in the erase process E of the last sub-field, the address driver 6 generates an erase pulse AP to apply it to respective column electrodes $D_{1\sim m}$. The second sustain driver 8 generates the erase pulse EP simultaneously at the application timing of such erase pulse AP to apply it to respective row electrodes $Y_1$ to $Y_n$. This simultaneous application of the erase pulses AP and EP causes erase discharge to be generated in all discharge cells of the PDP 10, allowing wall charges remaining within all discharge cells to disappear. That is, such erase discharge turns all discharge cells to non-light-emitting cells in the PDP 10.

FIG. 6 is a view showing all patterns of light-emission drive to be performed in accordance with the light-emission drive formats shown in FIG. 3, FIG. 4, and FIG. 5.

As shown in FIG. 6, the selective erase discharge is performed (shown with black circles) for respective discharge cells only at the pixel data write process Wc in one sub-field of the sub-fields SF1 through SF14. That is, the wall charges formed within all discharge cells of the PDP 10 by the execution of the simultaneous reset process Rc remain until the aforementioned selective erase discharge is performed. The charges promote discharge light-emission (shown with white circles) at the light-emission sustain process Ic present over that period in respective sub-fields SF. That is, each of the discharge cells acts as light-emitting cells within one field period until the aforementioned selective erase discharge is performed. The discharge cell continues light-emission at the ratio of the light-emission periods shown in FIG. 3 at the light-emission sustain process Ic present over that period in respective sub-fields.

At this time, as shown in FIG. 6, the number of frequencies at which respective discharge cells change from a light-emitting cell to a non-light-emitting cell is made equal to one or less in one field period without exception. That is, in one field period, such a light-emitting drive pattern is prohibited that allows a discharge cell that has been set to a non-light-emitting cell to be restored again to a light-emitting cell.

Accordingly, the aforementioned simultaneous reset operation that accompanies intense light-emission irrespective of no involvement in displaying picture images may be performed once in one field period as shown in FIG. 3, FIG. 4, and FIG. 5, thereby allowing to prevent degradation in contrast.

Furthermore, the selective erase discharge is performed only once at most within one field period as shown with the black circles of FIG. 6, thereby allowing to reduce power consumption thereof.

Still furthermore, as shown in FIG. 6, no such a light-emitting pattern exists that allows a period under the light-emitting state and a period under a non-light-emitting state to be inverted with each other in one field period, so that a quasi-contour can be prevented.

Furthermore, for the aforementioned scan pulses SP, the pulse width thereof is set larger in the order of earlier occurrence of the sub-fields SF1 through SF14. In other words, supposing that SF1 is the first group (first sub-group) of sub-field, SF2 the second group (second sub-group) of sub-field, SF3 the third group (third sub-group) of sub-field . . . SF14 the 14th group (14th sub-group) of sub-field, the pulse width of the scan pulses SP in the first group (first sub-group) of sub-field SF1, that is, the head sub-field, is set to be larger than that of any other scan pulses in the other groups (sub-groups) of sub-fields SF2 through SF14. This is because of the following reason. In the case where a sub-field before the sub-field in which the selective erase discharge is performed repeats sufficient light-emission sustain discharge under the light-emitting state (under a high-intensity condition), a sufficient amount of priming particles are present in discharge spaces and thus the selective erase discharge is performed positively. On the other hand, take the case where no sub-field under the light-emitting state exists before a sub-field in which the selective erase discharge is performed. Take also another case where a small number of sub-fields under the light-emitting state exist (where the selective erase discharge is performed in sub-fields SF1 or SF2 under a low-intensity condition). In these cases, a small number of frequencies of the light-emission sustain discharge occur and thus no sufficient priming particles exist in the discharge spaces. Consider the case of the sub-field for the selective erase operation under the state in which no sufficient priming particles exist in the discharge, cells. In this case, a delay in time will be produced until the selective erase discharge takes place after the scan pulse SP has been applied. This will cause the selective erase discharge to be unstable, so that erroneous discharge will occur within the period of the sustain discharge and thus display quality will be degraded. Accordingly, the pulse width of the scan pulse SP is set larger in the order of earlier occurrence of the sub-fields SF1 through SF14. This assures that the selective erase discharge takes place positively during the application of the scan pulses SP, thereby allowing to provide stability to the selective erase discharge.

Still furthermore, in the example of FIG. 5, the pulse width $T_{SYi}$ of the sustain pulse $IP_{Yi}$ which is applied finally to the row electrodes $Y_1$ to $Y_n$ in each of the sub-fields SF1 through SF14 is made larger than any pulse widths $T_{SY1}$ to $T_{Syi-1}$ of the previous sustain pulses $IP_{Y1}$ to $IP_{Yi-1}$. This will cause the amount of wall charges to increase at the time of completion of respective sub-fields SF1 through SF14. Thus, this allows the selective erase discharge in the subsequent sub-field to prevent variations in time, thereby allowing the selective erase discharge to be stabilized in a far better manner and the display quality to be improved.

Furthermore, as mentioned above, the pulse width $T_{SX1}$ of the sustain pulse $IP_{X1}$ which is applied first to the row electrodes $X_1$ to $X_n$ in each of the sub-fields SF1 through SF14 is made larger than any pulse widths $T_{SX2}$ to $T_{Sxi}$ of the subsequent sustain pulses $IPX_2$ to $IP_{Xi}$. This is because no sufficient charged particles exist in the discharge spaces at the time of starting the light-emission sustain process Ic in some cases and thus the first sustain pulse $IP_X$ may cause the sustain discharge to be delayed. Therefore, the pulse width $T_{SX1}$ of the sustain pulse $IP_X$ is made larger to absorb the delay in the sustain discharge and thus allow the sustain discharge to be performed positively.

Figure 7:
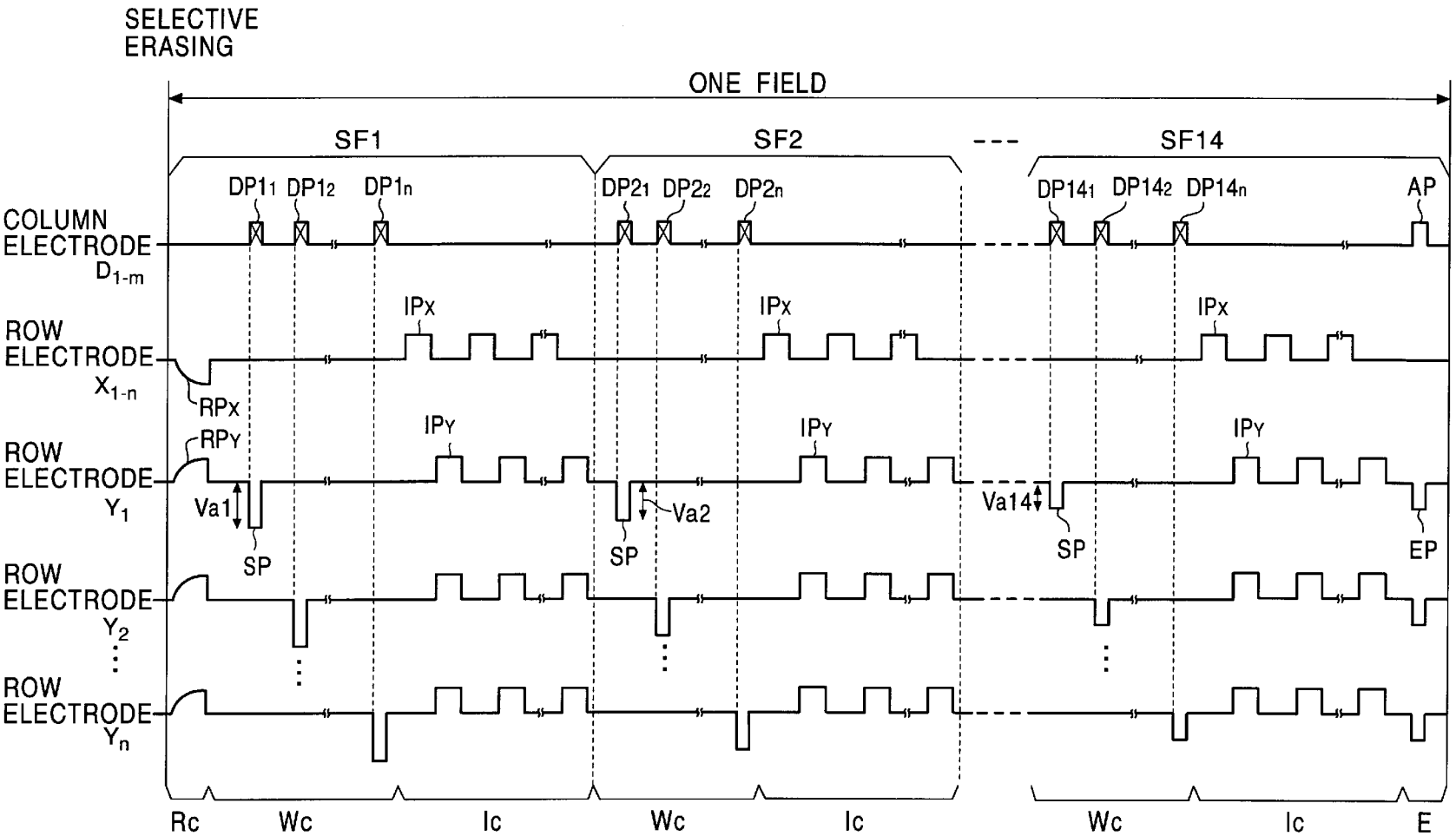
FIG. 7 is a view showing an example of application timing of various drive pulses to be applied to PDP 10.
Figure 8:
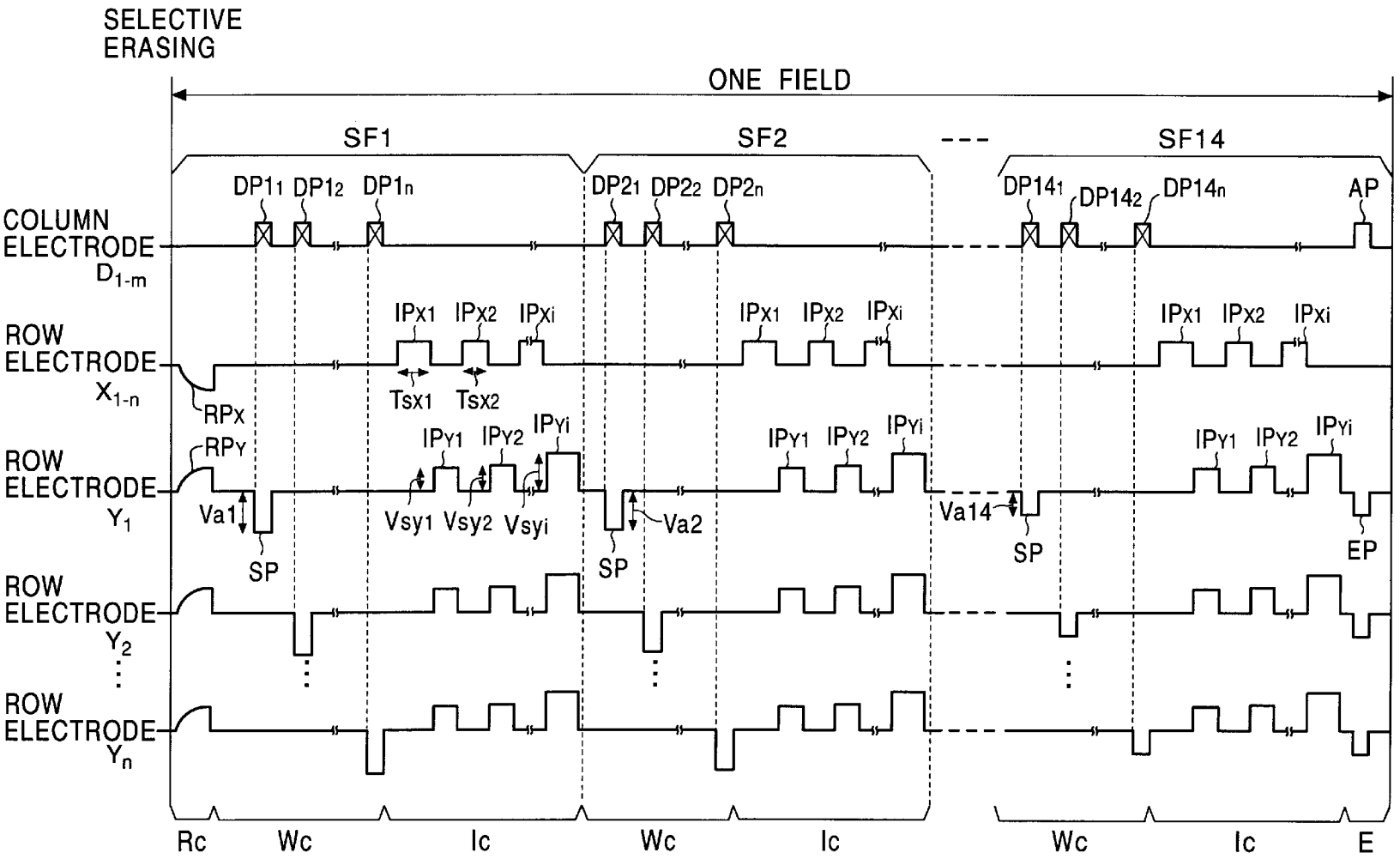
FIG. 8 is a view showing another example of application timing of various drive pulses to be applied to PDP 10.

Furthermore, without changing the pulse widths of the respective scan pulses SP and sustain pulses $IP_{Yi}$, the pulse voltage of the scan pulses SP may be set larger in the order of earlier occurrence of the sub-fields SF1 through SF14 as shown in FIG. 7 and FIG. 8. Additionally, the pulse voltage $V_{SYi}$ of the sustain pulse $IP_{Yi}$ which is applied finally to the row electrodes $Y_1$ to $Y_n$ in each of the sub-fields SF1 through SF14 may be made larger than any pulse voltages $V_{SY1}$ to $V_{Syi-1}$ of the previous sustain pulses $IP_{Y1}$ to $IP_{Yi-1}$. Moreover, in this example of each pulse application timing, as shown in FIG. 7 and FIG. 8, supposing that the pulse voltages of the scan pulses SP corresponding to respective sub-fields SF1 through SF14 are Va1 through Va14, the following relationship holds. Namely, $$Va1>Va2>Va3>Va4> \ldots >Va12>Va13>Va14$$

In other words, supposing that SF1 is the first group of the sub-field, SF2 the second sub-field, SF3 the third sub-field . . . SF14 the 14th sub-field, the pulse width of the scan pulses SP in the first group of sub-field SF1, the head sub-field, is set to be larger than that of any other scan pulses in the other groups of sub-fields SF2 through SF14. This allows the voltage level of the scan pulses SP to become higher than the voltage level of the sub-fields subsequent in terms of time even in the sub-fields SF1 or SF2, thereby allowing the selective erase discharge to take place positively. Incidentally, the example of FIG. 8 is the same as that of the application timing of FIG. 5 in that the pulse width $T_{SX1}$ of the sustain pulse $IP_{X1}$ which is applied first to the row electrodes $X_1$ to $X_n$ in each of the sub-fields SF1 through SF14 is made larger than any pulse widths $T_{SX2}$ to $T_{Sxi}$ of the subsequent sustain pulses $IP_{X2}$ to $IP_{Xi}$.

Figure 9:
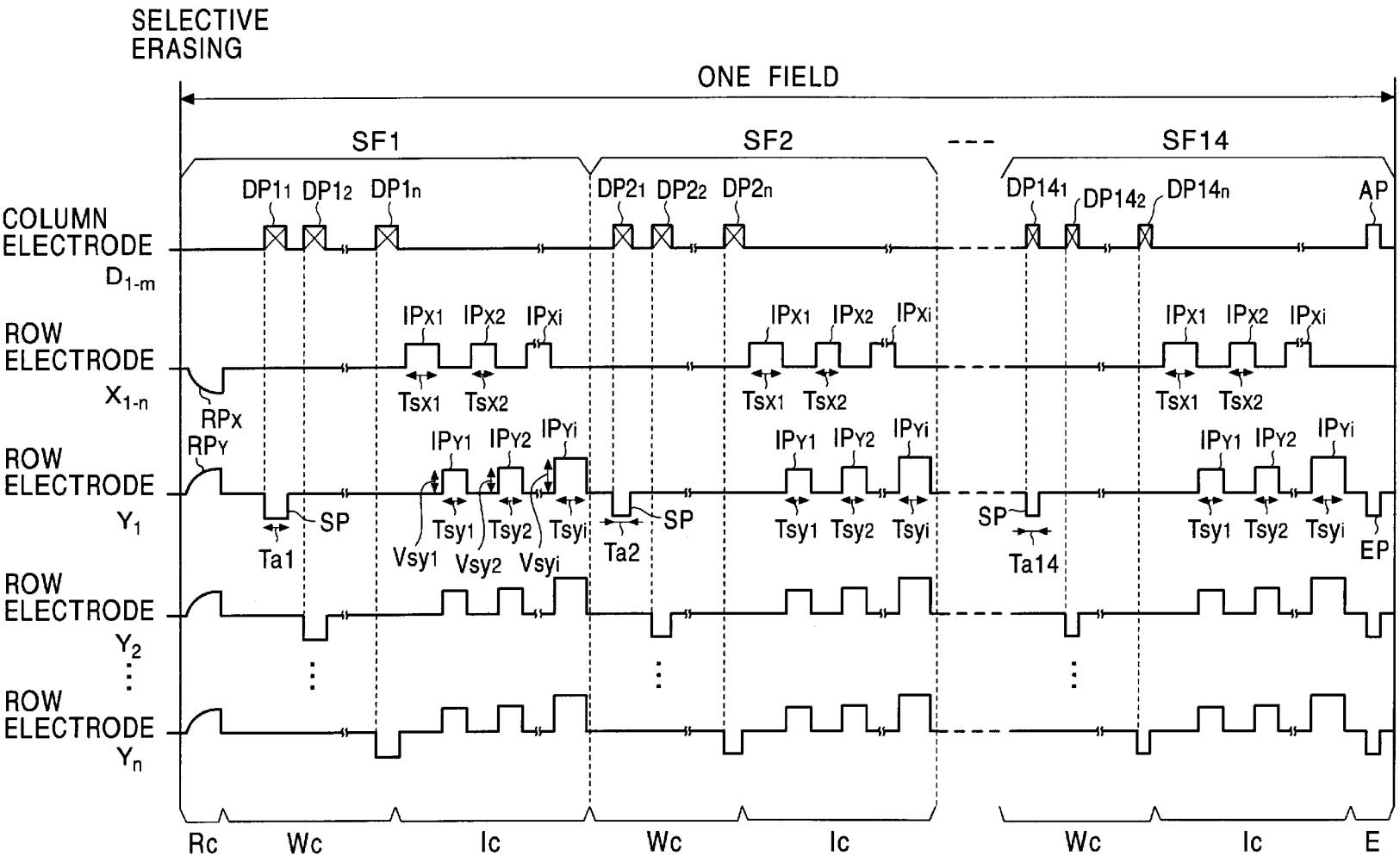
FIG. 9 is a view showing an example of application timing of various drive pulses to be applied to PDP 10.

Furthermore, as shown in FIG. 9, both the pulse width $T_{SYi}$ and the pulse voltage $V_{Syi}$ of the sustain pulse $IP_{Yi}$ which is applied finally to the row electrodes $Y_1$ to $Y_n$ in each of the sub-fields SF1 through SF14 may be made larger than the pulse widths $T_{SY2}$ to $T_{SYi}$ and the pulse voltages $V_{SY1}$ to $V_{Syi-1}$ of the previous sustain pulses $IP_{Y1}$ to $IP_{Yi-1}$. Incidentally, like the application timing of FIG. 4, the pulse width of the scan pulses SP is set larger in the order of earlier occurrence of the sub-fields SF1 through SF14.

Furthermore, the pulse widths Ta1 to Ta14 and pulse voltages Va2 through Va14 of the scan pulses of respective sub-fields within sub-field groups constituted by the sub-fields SF1 through SF14 may be set, for example, as follows. That is, $$Ta1=Ta2=Ta3=Ta4>Ta5=Ta6=Ta7=Ta8>Ta9=Ta10=Ta11=Ta12=Ta13=Ta14,$$

and $$Va1=Va2=Va3=Va4>Va5=Va6=Va7=Va8>Va9=Va10=Va11=Va12=Va13=Va14.$$

In this case, the respective sub-fields within the sub-field groups constituted by the SF1 through SF14 are divided according to the pulse waveform of the scan pulse SP within respective sub-fields into a plurality of groups (sub-groups), that is, a first group (first sub-group) including at least the head sub-fields constituted by the SF1 through SF4, a second group (second sub-group) constituted by the SF5 through SF8, and a third group (third sub-group) constituted by the SF9 through SF14. Additionally, at least one of the pulse widths and the pulse voltages of the scan pulse SP within the sub-field belonging to the first group is set larger than the respective value of the scan pulse within the sub-field belonging to the second and third group.

Figure 10:
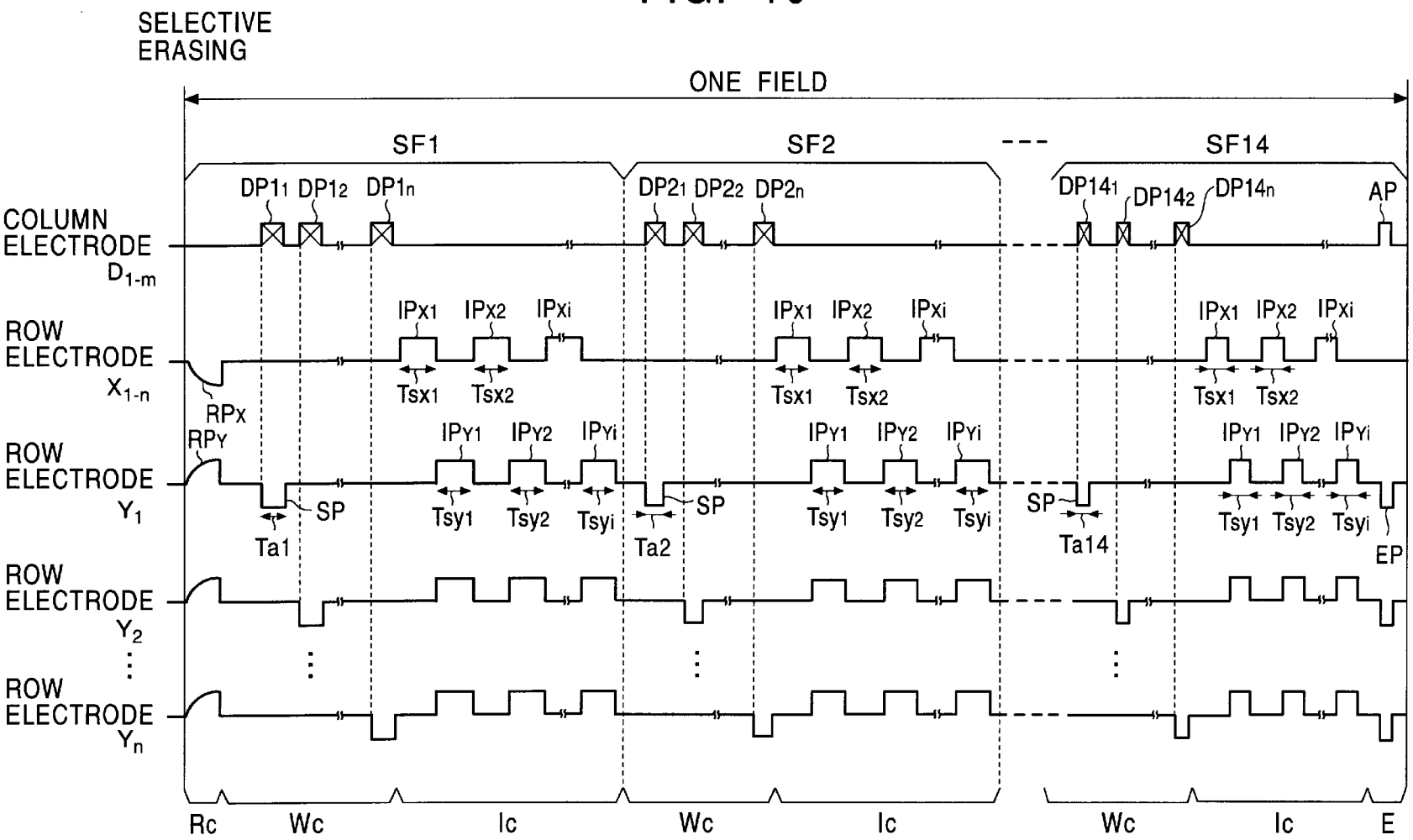
FIG. 10 is a view showing an example of application timing of various drive pulses to be applied to PDP 10.

FIG. 10 shows an example of the application timing of various drive pulses to be applied to the PDP 10. In this application timing, like the application timing of FIG. 5, the pulse width of the scan pulse SP is set larger in the order of earlier occurrence of the sub-fields SF1 through SF14. Moreover, at the light-emission sustain process Ic in a sub-field that occurs later chronologically in the sub-fields SF1 through SF14 within one sub-field group, for example, in the sub-field SF14, the pulse width $T_{SYi}$ of the sustain pulse $IP_{Yi}$ which is applied finally to the row electrodes $Y_1$ to $Y_n$ is made larger than any pulse widths $T_{SX1}$ to $T_{SXi-1}$ of the previous sustain pulses $IP_{Y1}$ to $IP_{Yi-1}$.

Furthermore, in the application timing of FIG. 10, at the light-emission sustain process Ic in a sub-field that occurs earlier chronologically in the sub-fields SF1 through SF14 within one sub-field group, for example, in the sub-fields SF1 and SF2, the pulse widths $T_{SX1}$ to $T_{SXi}$ of the sustain pulses $IP_{X1}$ to $IP_{Xi}$ which are applied to the row electrodes $X_1$ to $X_n$ and the pulse widths $T_{SY1}$ to $T_{SYi}$ of the sustain pulses $IP_{Y1}$ to $IP_{Yi}$ which are applied to the row electrodes $Y_1$ to $Y_n$ are set larger than the pulse width (for example, the pulse widths $T_{SY1}$ to $T_{Syi-1}$ of the sustain pulses $IP_{Y1}$ and $IP_{Yi-1}$ except for $IP_{Yi}$) of the sustain pulse to be applied in the middle to the row electrodes $Y_1$ to $Y_n$ of a sub-field which occur later chronologically in the sub-fields SF1 through SF14, for example, in the sub-field SF14. Incidentally, the pulse voltage may be made larger instead of the pulse width.

Incidentally, according to the light-emission pattern shown in FIG. 6, an expression with 15 levels of halftone with the following light-emitting brightness is made possible. That is,

{0, 1, 4, 9, 17, 27, 40, 56, 75, 97, 122, 150, 182, 217, 256}

However, the pixel data D supplied by the aforementioned A/D converter 1 is 8-bit data, that is, the data expresses 256 levels of halftone.

Accordingly, in order to implement display with 256 levels of halftone in a pseudo manner by the aforementioned 15-level gray scale drive, data conversion is performed by means of the data conversion circuit 30 shown in FIG. 2.

Figure 11:
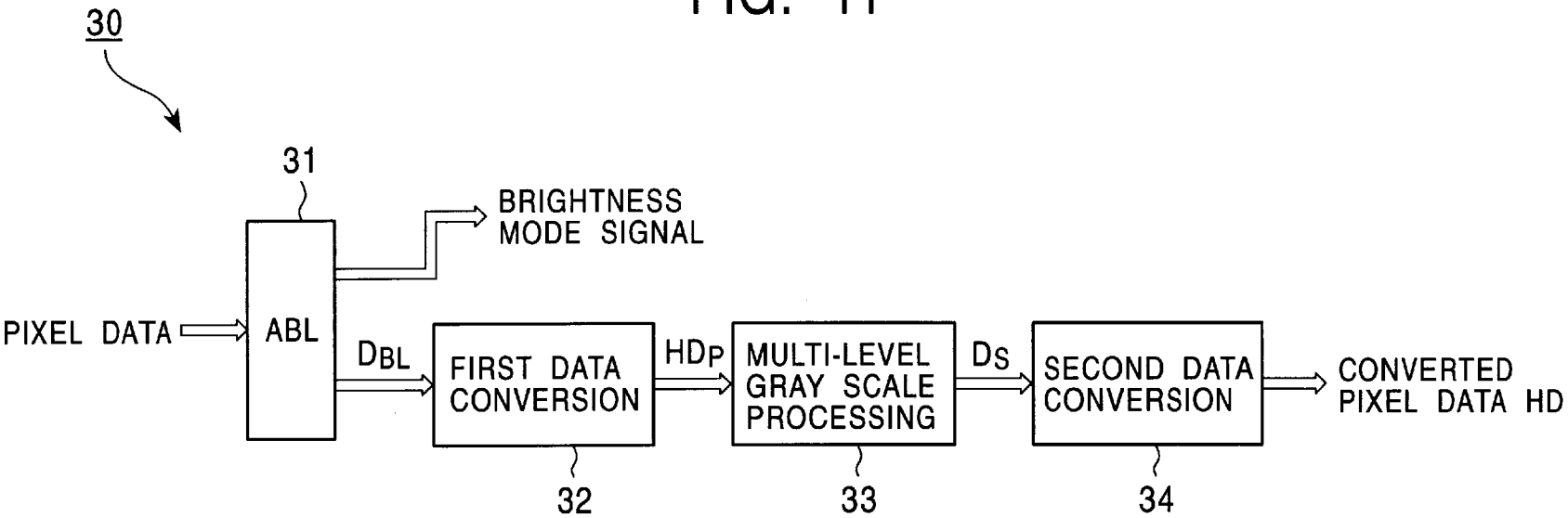
FIG. 11 is a view showing the internal configuration of data conversion circuit 30.

FIG. 11 is a view showing the internal configuration of the data conversion circuit 30.

In FIG. 11, ABL (automatic brightness control) circuit 31 adjusts the brightness level of the pixel data D for respective pixels supplied in sequence from the A/D converter 1 so that the average brightness of the pixels displayed on the screen of the PDP 10 falls within the predetermined range of brightness. Then, the ABL circuit 31 supplies the brightness adjusted pixel data $D_{BL}$ thus obtained to the first data conversion circuit 32.

Such an adjustment of brightness levels is carried out by setting the ratio of the number of frequencies of light-emissions of sub-fields non-linearly before the inverse Gamma compensation is performed. Thus, the ABL circuit 31 is configured so as to apply the inverse Gamma compensation to the pixel data (input pixel data) D and adjust automatically the brightness level of the aforementioned pixel data D in response to the average brightness of the inverse Gamma converted pixel data thus obtained. This allows for preventing degradation of the display quality caused by the brightness adjustment.

Figure 12:
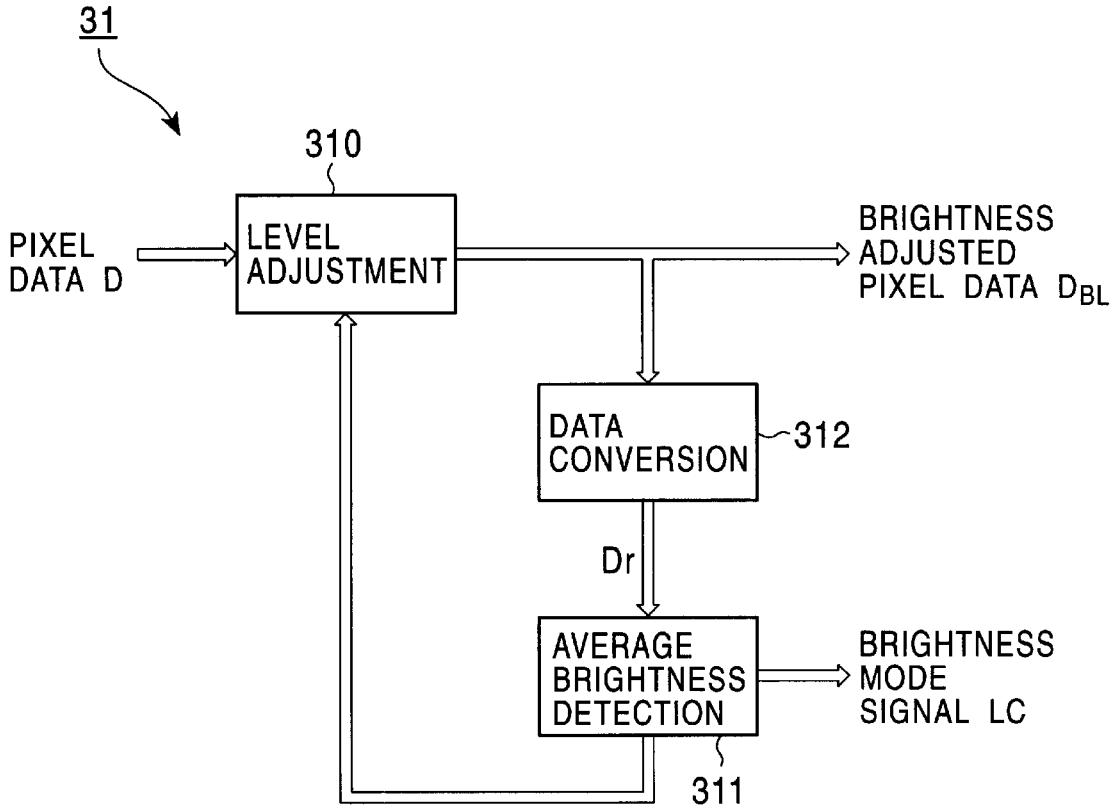
FIG. 12 is a view showing the internal configuration of ABL circuit 31.
Figure 13:
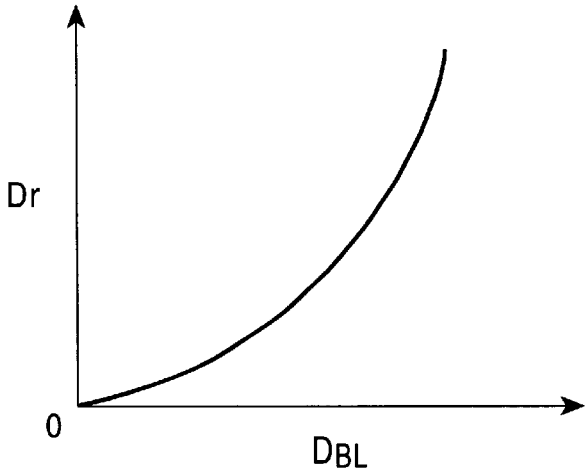
FIG. 13 is a view showing the conversion characteristics of the data conversion circuit 312.

FIG. 12 is a view showing the internal configuration of such an ABL circuit 31. In FIG. 12, the level adjustment circuit 310 outputs the brightness adjusted pixel data $D_{BL}$ obtained by adjusting the level of the pixel data D in response to the average brightness determined by the average brightness detection circuit 311 which is to be described later. The data conversion circuit 312 supplies such brightness adjusted pixel data $D_{BL}$ which has been converted by the inverse Gamma characteristics ($Y=X^{2.2}$) comprising the non-linear characteristics shown in FIG. 13 to the average brightness detection circuit 311 as the inverse Gamma converted pixel data Dr.

That is, the data conversion circuit 312 restores the pixel data (the inverse Gamma converted pixel data Dr) with the Gamma compensation undone and corresponding to an original video signal by applying the inverse Gamma compensation to the brightness adjusted pixel data $D_{BL}$. The average brightness detection circuit 311 selects a brightness mode which allows the PDP 10 to be driven to emit light at the brightness corresponding to the average brightness determined as mentioned above among the brightness modes that specify the light-emission period in each of the sub-fields, for example, brightness modes 1 to 4 shown in FIG. 14. Then, the average brightness detection circuit 311 supplies the brightness mode signal LC that shows the brightness mode selected to the drive control circuit 2. At this time, the drive control circuit 2 sets the number of sustain pulses in accordance with the mode specified by the brightness mode signal LC shown in FIG. 14, said sustain pulses being applied during the period of light-emission sustain at the light-emission sustain process Ic in the sub-fields SF1 through SF14 shown in FIG. 3, that is, in the each light-emission sustain process Ic. That is, the period of light-emission at each sub-field shown in FIG. 3 shows the light-emission period when the brightness mode 1 is set. In the case where the brightness mode 2 is set, driving for emitting light is performed at each sub-field for the following period of light emission. That is, SF1: 2
SF2: 6
SF3: 10
SF4: 16
SF5: 20
SF6: 26
SF7: 32
SF8: 38
SF9: 44
SF10: 50
SF11: 56
SF12: 64
SF13: 70
SF14: 78

Incidentally, in such a driving for emitting light, the ratio of the number of frequencies of light emissions at respective sub-fields SF1 through SF14 is set non-linearly (that is, to the inverse Gamma ratio, $Y=X^{2.2}$). This allows the non-linear characteristics (the Gamma characteristics) of the input pixel data D to be compensated for.

The average brightness detection circuit 311 determines the average brightness based on such inverse Gamma converted pixel data Dr, said average brightness then being supplied to the aforementioned level adjustment circuit 310.

Figure 15:
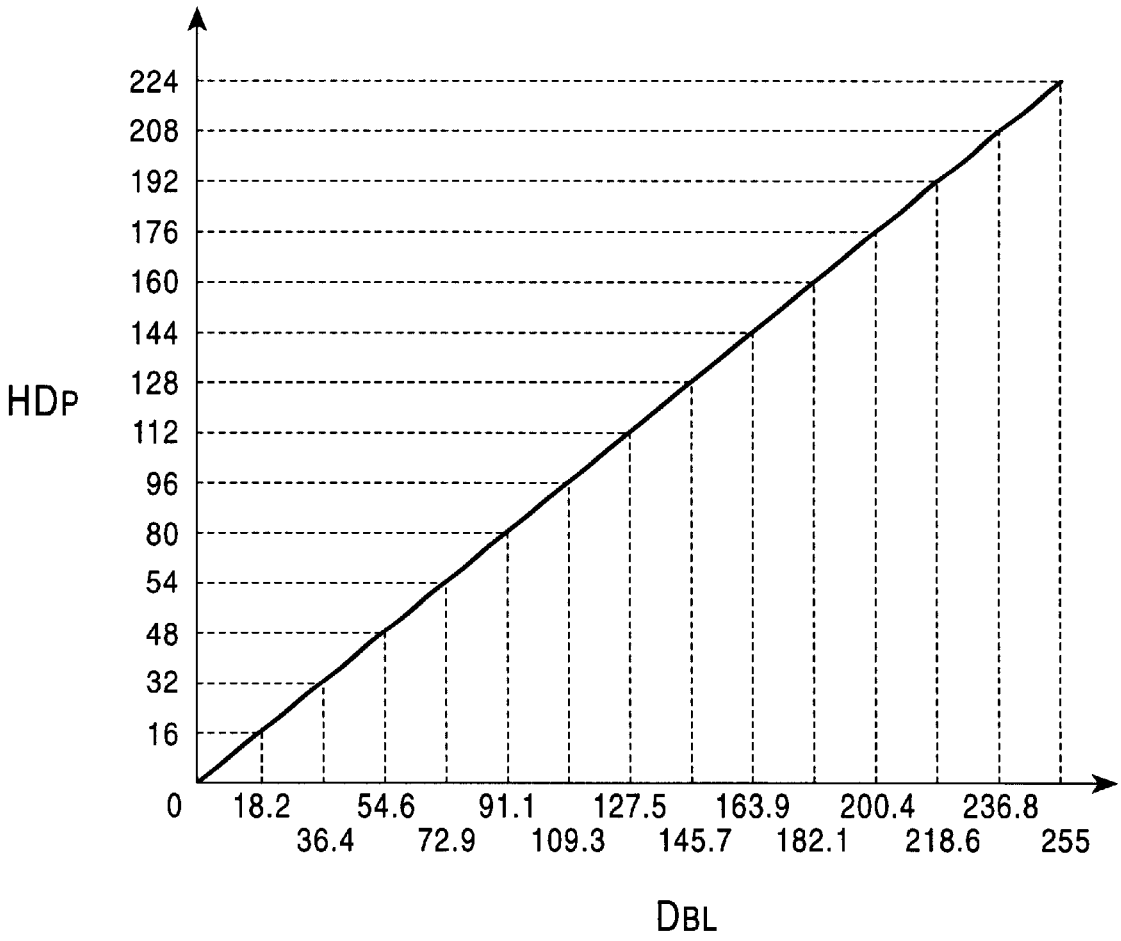
FIG. 15 is a view showing the conversion characteristics of the first data conversion circuit 32.

The first data conversion circuit 32 in FIG. 11 converts the brightness adjusted pixel data $D_{BL}$ of 256-level gray scale (8 bits) into the converted pixel data $HD_P$ of 8 bits (0 to 224), which is the brightness adjusted pixel data $D_{BL}$ multiplied by 14×16/255 (224/255), in accordance with the conversion characteristics shown in FIG. 15. Then the first data conversion circuit 32 supplies the converted pixel data $HD_P$ to the multi-level gray scale processing circuit 33. Specifically, the 8-bit (0 to 255) brightness adjusted pixel data $D_{BL}$ is converted in accordance with the conversion table, based on such conversion characteristics, shown in FIG. 16 and FIG. 17. That is, these conversion characteristics are set in accordance with the number of bits of input pixel data, the number of compressed bits resulting from multi-level gray scale processing, and the number of gray scale levels for display. As such, the first data conversion circuit 32 is provided at the front stage of the multi-level gray scale processing circuit 33 which is to be described later, thereby allowing to perform conversion to the number of gray scale levels for display and the number of compressed bits resulting from multi-level gray scale processing. This allows the brightness adjusted pixel data $D_{BL}$ to be divided at the bit boundary into the upper bit group (corresponding to multi-level gray scale pixel data) and lower bit group (data to be discarded, error data). In accordance with this signal, the multi-level gray scale processing is to be performed. This allows for preventing the occurrence of flat portions in the display characteristics (that is, the occurrence of disorder in the gray scale level), said flat portions being produced in the case of occurrence of brightness saturation resulting from the multi-level gray scale processing and absence of display levels of gray scale at a bit boundary.

Incidentally, the lower bit group is discarded and thus the number of gray scale levels is reduced, however, the number of gray scale levels reduced is designed to be obtained in a quasi manner by the operation of the multi-level gray scale processing circuit 33 which is to be explained below.

Figure 18:
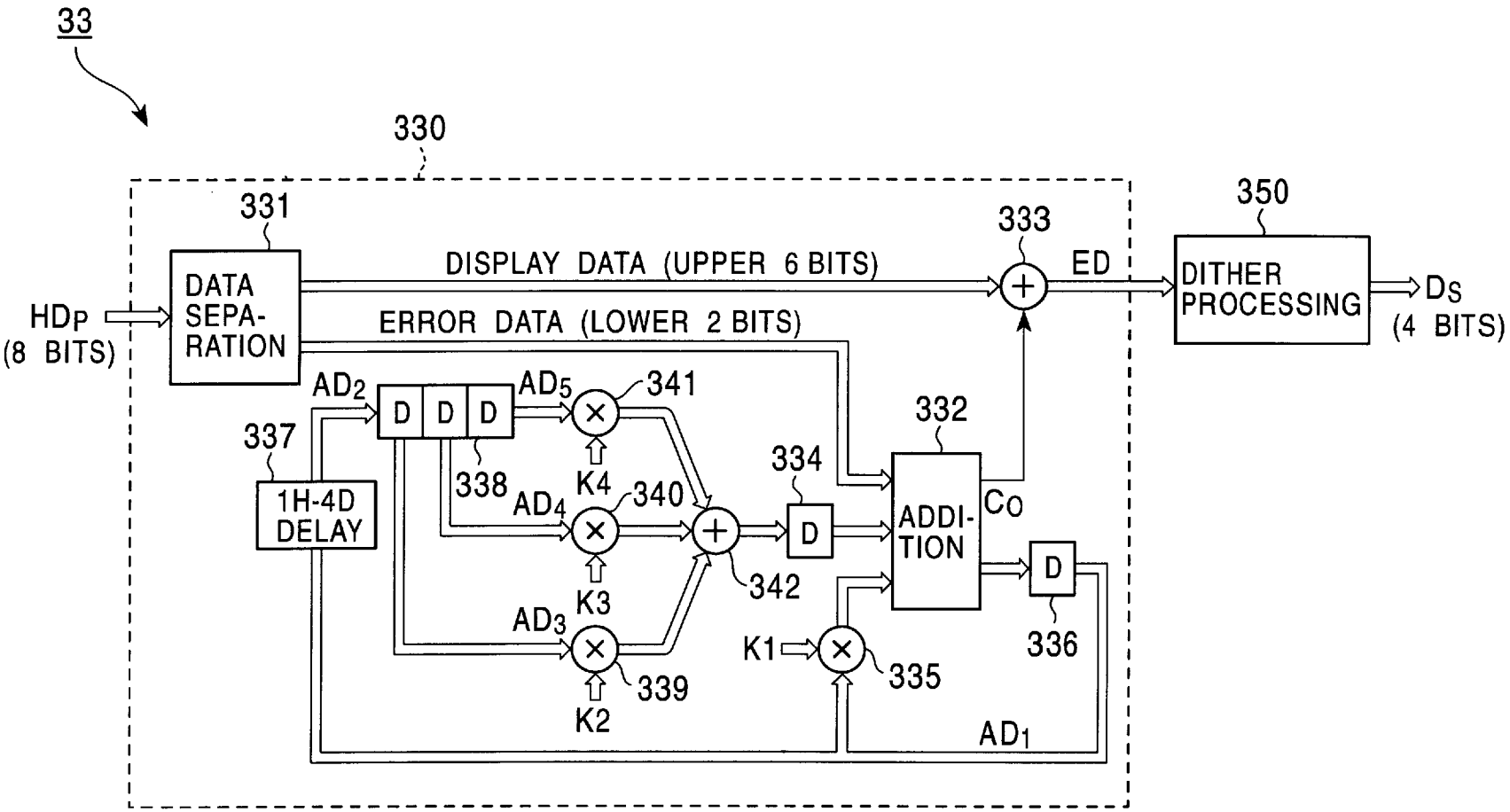
FIG. 18 is a view showing the internal configuration of multi-level gray scale processing circuit 33.

FIG. 18 is a view showing the internal configuration of the multi-level gray scale processing circuit 33.

As shown in FIG. 18, the multi-level gray scale processing circuit 33 comprises the error diffusion processing circuit 330 and the dither processing circuit 350.

First, the data separation circuit 331 of the error diffusion processing circuit 330 separates the lower 2 bits of the 8-bit converted pixel data $HD_P$ supplied by the aforementioned first data conversion circuit 32 into error data and the upper 6 bits into display data.

The adder 332 supplies, to the delay circuit 336, an additional value obtained by adding the lower 2 bits as error data of the converted pixel data $HD_p$, the delay output from the delay circuit 334, and a multiplication output of the scale multiplier 335. The delay circuit 336 causes the additional value supplied by the adder 332 to be delayed by the delay time D of the same length of time as the clock period of the pixel data. Then, the delay circuit 336 supplies the additional value to the aforementioned scale multiplier 335 and the delay circuit 337 as the delay additional signal $AD_1$, respectively.

The scale multiplier 335 multiplies the aforementioned delay additional signal $AD_1$ by the predetermined coefficient $K_1$ (for example, "7/16") and then supplies the resultant to the aforementioned adder 332.

The delay circuit 337 causes further the aforementioned delay additional signal $AD_1$ to be delayed by the time (equal to one horizontal scan period–the aforementioned delay time D×4) and then supplies the resultant to the delay circuit 338 as the delay additional signal $AD_2$. The delay circuit 338 causes a further such delay additional signal $AD_2$ to be delayed by the aforementioned delay time D and then supplies the resultant to the scale multiplier 339 as the delay additional signal $AD_3$. Moreover, the delay circuit 338 causes further such delay additional signal $AD_2$ to be delayed by the aforementioned delay time D×2 and then supplies the resultant to the scale multiplier 340 as the delay additional signal AD4. Still moreover, the delay circuit 338 causes a further such delay additional signal AD2 to be delayed by the aforementioned delay time D×3 and then supplies the resultant to the scale multiplier 341 as the delay additional signal $AD_5$.

The scale multiplier 339 multiplies the aforementioned delay additional signal $AD_3$ by the predetermined coefficient $K_2$ (for example, "3/16") and then supplies the resultant to the adder 342. The scale multiplier 340 multiplies the aforementioned delay additional signal AD4 by the predetermined coefficient $K_3$ (for example, "5/16") and then supplies the resultant to the adder 342. The scale multiplier 341 multiplies the aforementioned delay additional signal AD5 by the predetermined coefficient $K_4$ (for example, "1/16") and then supplies the resultant to the adder 342.

The adder 342 supplies, to the aforementioned delay circuit 334, the additional signal that has been obtained by adding the results of multiplication supplied by the aforementioned respective scale multipliers 339, 340, and 341. The delay circuit 334 causes such an additional signal to be delayed by the aforementioned delay time D and then supplies the resultant signal to the aforementioned adder 332. The adder 332 adds the aforementioned error data (lower two bits of the converted pixel data $HD_P$), the delay output from the delay circuit 334, and the output of multiplication of the scale multiplier 335. In this case, the adder 332 generates the carry-out signal $C_o$ which is equal to logic "0" in absence of carry and logic "1" in the presence of a carry and supplies the signal to the adder 333.

The adder 333 adds the aforementioned display data (upper 6 bits of the converted pixel data $HD_P$) to the aforementioned carry-out signal $C_o$ and outputs the resultant as the 6-bit error diffusion processing pixel data ED.

The operation of the error diffusion processing circuit 330 comprising as such is to be explained below.

Figure 19:
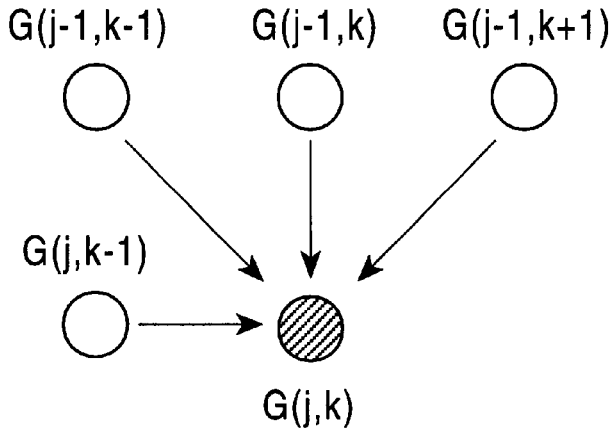
FIG. 19 is an explanatory view showing the operation of error diffusion processing circuit 330.

For example, in order to determine the error diffusion processing pixel data ED corresponding to a pixel G (j, k) of the PDP 10 shown in FIG. 19, the respective error data corresponding to each of a pixel G (j, k−1) to the left of such pixel G (j, k), a pixel G (j−1, k−1) to the upper left, a pixel G (j−1, k) immediately above, and a pixel G (j−1, k+1) to the upper right, that is:

Error data corresponding to the pixel G (j, k−1), the delay additional signal $AD_1$:

Error data corresponding to the pixel G (j−1, k+1), the delay additional signal $AD_3$;

Error data corresponding to the pixel G (j−1, k), the delay additional signal $AD_4$; and Error data corresponding to the pixel G (j−1, k−1), the delay additional signal $AD_5$ are respectively provided with weights of the predetermined coefficients $K_1$ through $K_4$ for addition. Subsequently, the result of the addition is added by the error data corresponding to the lower two bits of the converted pixel data $HD_P$, that is, pixel G (j, k). Then, the carry-out signal $C_o$ for one bit thus obtained is added to the display data corresponding to the upper six bits of the converted pixel data $HD_P$, that is, the pixel G (j, k) and the resultant is the error diffusion processing pixel data ED.

The error diffusion processing circuit 330 with such a configuration interprets the upper 6 bits of the converted pixel data HDP as display data and the remaining lower 2 bits as error data. The circuit also allows for adding the error data of the surrounding pixels {G (j, k−1), G (j−1, k+1), G (j−1, k), G (j−1, k−1)} by assigning weights thereto and the resultant is to be reflected to the aforementioned display data. This operation allows the brightness of the lower 2 bits at the original pixel {G (j, k)} to be expressed by the aforementioned surrounding pixels in a quasi manner. Therefore, this allows the display data of the number of bits less than 8 bits, that is, equal to 6 bits to express the levels of gray scale of brightness equivalent to those expressed by the aforementioned 8-bit pixel data.

Incidentally, an even addition of these coefficients of error diffusion to respective pixels would cause the noise resulting from error diffusion patterns to be visually noticed and thus produce an adverse effect on display quality. Accordingly, like the case of the dither coefficients to be described later, the coefficients $K_1$ through $K_4$ for error diffusion that should be assigned to the respective four pixels may be changed at each field.

The dither processing circuit 350 applies the dither processing to the error diffusion processing pixel data ED supplied by the error diffusion processing circuit 330, thereby generating the multi-level gray scale processing pixel data $D_s$ whose number of bits is reduced further to 4 bits, while maintaining the level of gray scale of the same brightness as the 6-bit error diffusion processing pixel data ED. Incidentally, the dither processing allows a plurality of adjacent pixels to express one intermediate display level. Take as an example the case of the display of halftone corresponding to 8 bits by using the display data of the upper 6 bits out of 8-bit pixel data. Four pixels adjacent to each other on the right and left, and above and below are taken as one set. Four dither coefficients a to d having values different from each other are assigned to respective pixel data corresponding to each of the pixels in the set for addition. The dither processing is to produce four different combinations of intermediate display levels with four pixels. Therefore, even with the number of bits of the pixel data equal to 6 bits, the brightness levels of the gray scale available for display are 4 times, that is, halftone display corresponding to 8 bits becomes available.

However, an even addition of the dither patterns with the coefficients a to d to respective pixels would cause the noise resulting from the dither patterns to be visually noticed and thus produce an adverse effect on display quality. Accordingly, the dither coefficients a to d that should be assigned to respective four pixels are to be changed at each field.

Figure 20:
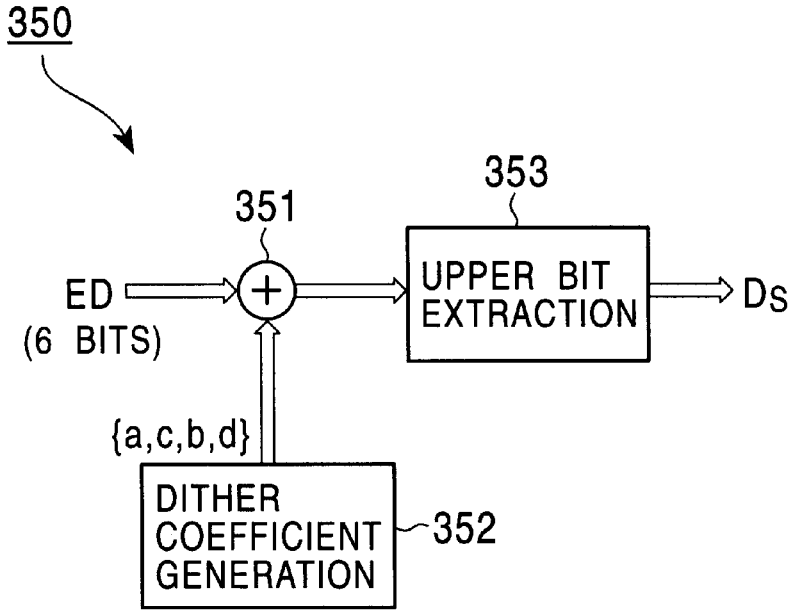
FIG. 20 is a view showing the internal configuration of dither processing circuit 350.

FIG. 20 is a view showing the internal configuration of such a dither processing circuit 350. In FIG. 20, the dither coefficient generation circuit 352 generates four dither coefficients a, b, c, and d for every four pixels adjacent to each other and supplies these coefficients in sequence to the adder 351.

Figure 21:
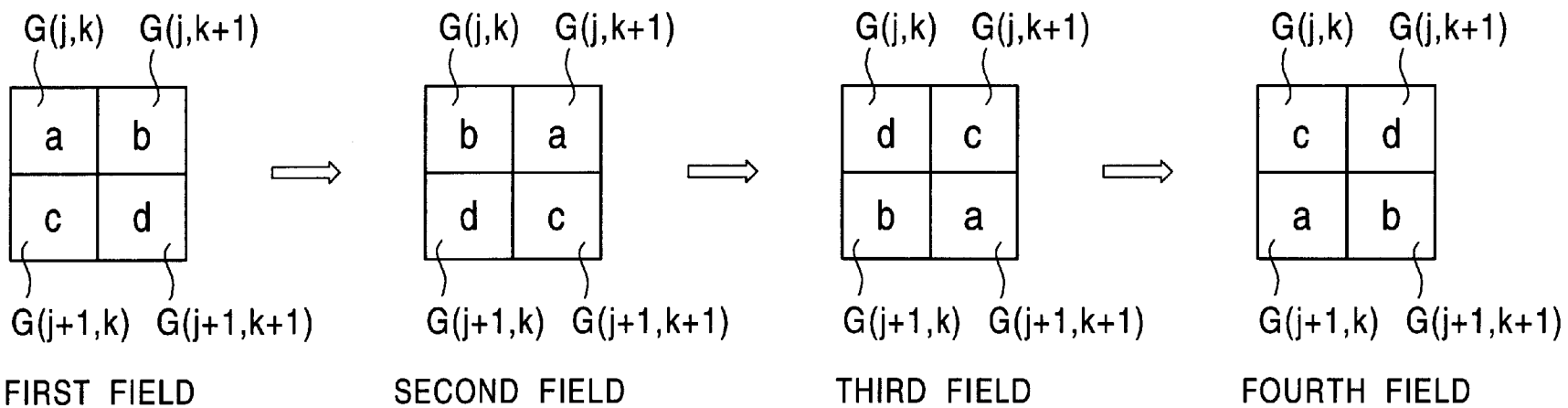
FIG. 21 is an explanatory view showing the operation dither processing circuit 350.

For example, as shown in FIG. 21, the circuit generates four dither coefficients a, b, c, and d corresponding to four pixels respectively of pixel G (j, k) and pixel G (j, k+1) corresponding to the jth row, and pixel G (j+1, k) and pixel G (j+1, k+1) corresponding to the (j+1)th row. At this time, the dither coefficient generation circuit 352 changes, for each field as shown in FIG. 21, the aforementioned dither coefficients a, b, c, and d that should be assigned to the respective four pixels.

That is, dither coefficients a to d are assigned to the pixels at each field and generated repeatedly in a cyclic manner as shown below and supplied to the adder 351.

At the starting first field, pixel G (j, k), dither coefficient a, pixel G (j, k+1), dither coefficient b, pixel G (j+1, k), dither coefficient c, and pixel G (j+1, k+1), dither coefficient d;

at the subsequent second field, pixel G (j , k), dither coefficient b, pixel G (j, k+1), dither coefficient a, pixel G (j+1, k), dither coefficient d, and pixel G (j+1, k+1), dither coefficient c;

at the subsequent third field, pixel G (j, k), dither coefficient d, pixel G (j, k+1), dither coefficient c, pixel G (j+1, k), dither coefficient b, and pixel G (j+1, k+1), dither coefficient a;

and, at the fourth field, pixel G (j, k), dither coefficient c, pixel G (j, k+1), dither coefficient d, pixel G (j+1, k), dither coefficient a, and pixel G (j+1, k+1), dither coefficient b;

The dither coefficient generation circuit 352 executes repeatedly the operation of the first to fourth fields mentioned above. That is, upon completion of generating the dither coefficients at the fourth field, the above-mentioned operation is repeated all over again from the aforementioned first field.

The adder 351 adds the dither coefficients a to d which are assigned to respective fields as mentioned above to respective error diffusion processing pixel data ED corresponding to the aforementioned pixel G (j, k), pixel G (j, k+1), pixel G (j+1, k), and pixel G (j+1, k+1) respectively, which are supplied by the aforementioned error diffusion processing circuit 330. The adder 351 then supplies the dither additional pixel data thus obtained to the upper bit extracting circuit 353.

For example, at the first field shown in FIG. 21, each of the following data is supplied sequentially as the dither additional pixel data to the upper bit extracting circuit 353.

That is, error diffusion processing pixel data ED corresponding to pixel G (j, k)+dither coefficient a, error diffusion processing pixel data ED corresponding to pixel G (j, k+1)+dither coefficient b, error diffusion processing pixel data ED corresponding to pixel G (j+1, k)+dither coefficient c, and error diffusion processing pixel data ED corresponding to pixel G (j+1, k+1)+dither coefficient d.

The upper bit extracting circuit 353 extracts the bits up to the upper four bits of such dither additional pixel data and then supplies the data to the second data conversion circuit 34 shown in FIG. 11 as multi-level gray scale pixel data $D_s$.

The second data conversion circuit 34 converts the multi-level gray scale pixel data $D_s$ into the converted pixel data (display pixel data) HD comprising the first to 14 bits corresponding to respective sub-fields SF1 through SF14 in accordance with the conversion table shown in FIG. 22. Incidentally, the multi-level gray scale pixel data $D_s$ is the input pixel data D of 8 bits (256-level gray scale) multiplied by 224/225 in accordance with the first data conversion (the conversion table of FIG. 16 and FIG. 17). Additionally, the data $D_s$ is the input pixel data D whose two bits are compressed, for example, by the error diffusion processing and the multi-level gray scale processing such as the dither processing into a total of 4 bits (15-level gray scale) of data.

In the foregoing, the bit with logic level "1" of the $1^{st}$ through $14^{th}$ bit of the converted pixel data HD shows that the selective erase discharge is to be performed at the pixel data write process Wc at the sub-fields SF corresponding to the bit.

In the foregoing, the aforementioned converted pixel data HD corresponding to respective discharge cells of the PDP 10 is supplied to the address driver 6 via the memory 4. At this time, the format of the converted pixel data HD corresponding to a discharge cell always takes one of the 15 patterns shown in FIG. 22. The address driver 6 assigns each of the $1^{st}$ through $14^{th}$ bits in the aforementioned converted pixel data HD to the respective sub-fields SF1 through SF14. Then, only when the bit logic is logic level "1", the address driver 6 generates a high-tension pixel data pulse at the pixel data write process Wc in the associated sub-field and supplies the pulse to the column electrodes D of the PDP 10. This allows for generating the aforementioned selective erase discharge.

As mentioned above, the pixel data D of 8 bits is converted into the converted pixel data HD of 14 bits by means of the data conversion circuit 30, and thus the display of 15-level gray scale shown in FIG. 22 is implemented. In this case, the operation of the multi-level gray scale processing circuit 33 mentioned above allows the practical sense of sight to recognize the expression with 256-level gray scale.

As mentioned above, the drive method shown in FIG. 3 through FIG. 22 first allows for generating discharge for initializing all discharge cells only in the head sub-field within one field period into the light-emitting cells (in the case of employing the selective erase discharge method) or the non-light-emitting cells (in the case of employing the selective write addressing method). Subsequently, only at the pixel data write process in either one of the sub-fields, respective discharge cells are set to non-light-emitting cells or light-emitting cells in response to pixel data. Moreover, at the light-emission sustain process of each sub-field, the only aforementioned light-emitting cells are allowed to emit light only for the period of light-emission corresponding to the weight of the sub-field. According to this drive method using the selective erase addressing method, sub-fields from head to tail in one field turn into the light-emitting state in sequence as the brightness to be displayed increases. On the other hand, in the case of employing the selective erase addressing method, the sub-fields are turned into the light-emitting state from the last to the top in one field as the brightness to be displayed increases.

Incidentally, in the aforementioned embodiment, the simultaneous reset operation is performed once in one field period, thereby allowing expression with the 15-level gray scale. However, it is possible to increase the number of gray scale levels by executing the simultaneous reset operation twice.

Figure 23:
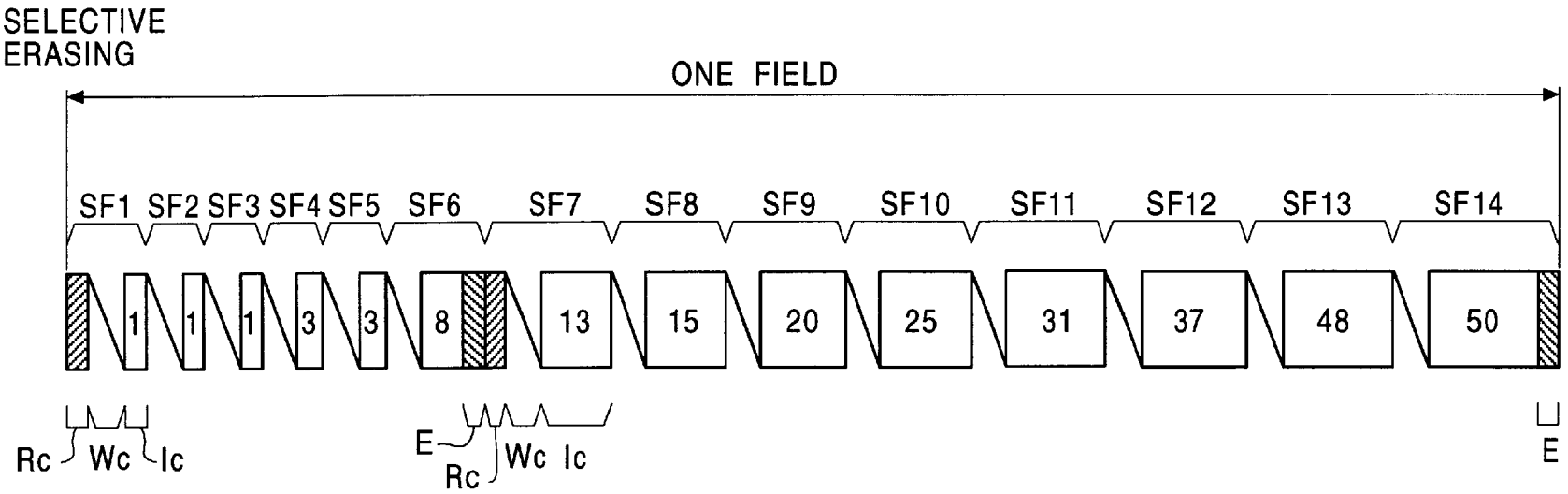
FIG. 23 is a view showing another example of a light-emission drive format when the selective erasing drive method is used.

FIG. 23 is a view showing a light-emission drive format developed in view of such a point.

Incidentally, FIG. 23 shows the light-emission drive format to be applied in the case of employing the selective erase addressing method mentioned above as the pixel data write method.

Even in the light-emission drive format shown in FIG. 23, one field period is also divided into 14 sub-fields comprising the sub-fields SF1 through SF14. In each sub-field, the pixel data write process Wc for writing pixel data to set light-emitting cells and non-light-emitting cells and the light-emission sustain process Ic are performed. At this time, supposing that the light-emission period of the sub-fields SF1 is equal to "1", the light-emission period (the number of light emissions) at each light-emission sustain process Ic is set as follows. That is, SF1: 1
SF2: 1
SF3: 1
SF4: 3
SF5: 3
SF6: 8
SF7: 13
SF8: 15
SF9: 20
SF10: 25
SF11: 31
SF12: 37
SF13: 48
SF14: 50

That is, the ratio of the number of light emissions of respective sub-fields SF1 through SF14 is set so as to be non-linear (that is, the inverse Gamma ratio, $Y=X^{2.2}$), thereby allowing to compensate for the non-linearity (the Gamma characteristics) of the input pixel data D.

Furthermore, of these respective sub-fields, the simultaneous reset process Rc is performed at the head sub-field and the intermediate sub-field.

That is, as shown in FIG. 23, the light-emission drive using the selective erase addressing method allows for performing the simultaneous reset process Rc at the sub-fields SF1 and SF7. Additionally, as shown in FIG. 23, the erase process E is executed for causing the wall charges remaining in all discharge cells to disappear in the last sub-field of one field and a sub-field immediately before the sub-field where the simultaneous reset process Rc is executed.

In the light emission drive format shown in FIG. 23, the pulse width of the scan pulse SP is also set larger for sub-fields that occur earlier chronologically in the order of the sub-fields SF1 through SF14. Alternatively, the pulse voltage of the scan pulse SP is set larger for sub-fields that occur earlier chronologically in the order of the sub-fields SF1 through SF14. The pulse width $T_{SX1}$ of the sustain pulse $IP_{X1}$ which is applied first to the row electrodes $X_1$ to $X_n$ in each of the sub-fields SF1 through SF14 is made larger than any pulse widths $T_{SX2}$ to $T_{Sxi}$ of the subsequent sustain pulses $IP_{X2}$ to $IP_{Xi}$. Moreover, the pulse width $T_{SYi}$ of the sustain pulse $IP_{Yi}$ which is applied finally to the row electrodes $Y_1$ to $Y_n$ in each of the sub-fields SF1 through SF14 is made larger than any pulse widths $T_{SY1}$ to $T_{SYi-1}$ of the previous sustain pulses $IP_{Y1}$ to $IP_{Yi-1}$. Furthermore, the drive method shown in FIG. 6 through FIG. 8 can be likewise applied to the light-emission drive format shown in FIG. 21.

FIG. 24 and FIG. 25 show an example of the conversion table to be used by the first data conversion circuit 32 shown in FIG. 11 in order to perform light-emission drive in accordance with the light-emission drive format shown in FIG. 23.

The first data conversion circuit 32 converts the input brightness adjusted pixel data $D_{BL}$ of 256-level gray scale (8 bits) into the converted pixel data $HD_P$ of 9 bits (0 to 352), which is the brightness adjusted pixel data DBL multiplied by 22×16/255 (352/255) in accordance with the conversion table shown in FIG. 24 and FIG. 25. Then the first data conversion circuit 32 supplies the converted pixel data $HD_P$ to the multi-level gray scale processing circuit 33. Like the foregoing, the multi-level gray scale processing circuit 33 compresses four bits of the converted pixel data $HD_P$ to output the multi-level gray scale pixel data $D_s$ of 5 bits (0 to 22).

At this time, the second data conversion circuit 34 shown in FIG. 11 converts the multi-level gray scale pixel data $D_s$ of 5 bits into the converted pixel data (display pixel data) HD of 14 bits in accordance with the conversion table shown in FIG. 26.

In the foregoing, FIG. 26 is a view showing, respectively, the conversion table and all patterns of light-emission drive to be used by the second data conversion circuit 34 in the case of employing the aforementioned selective erase addressing method as the pixel data write method.

As such, performing the drive shown in FIG. 23 through FIG. 26 allows expression with 23 levels of halftone with the following light-emission brightness that is also shown in FIG. 26.

That is,

{0, 1, 2, 3, 6, 9, 17, 22, 30, 37, 45, 57, 65, 82, 90, 113, 121, 150, 158, 195, 206, 245, 256}.

As mentioned above, the drive method shown in FIG. 23 through FIG. 26 allows for dividing the sub-fields of one field period into two sub-field groups comprising a plurality of sub-fields disposed continuously one after another. In the case of employing the selective erase addressing method, the drive method allows for dividing the sub-fields into the sub-field group comprising the sub-fields SF1 through SF6 and the sub-field group comprising sub-fields SF7 through SF14 as shown in FIG. 23. At this time, the drive method allows for generating discharge for initializing all discharge cells into the light-emitting cells by executing the simultaneous reset process Rc, respectively, only in the head sub-field of each sub-field group. In the foregoing, only at the pixel data write process in either one of sub-fields of respective sub-field groups, discharge cells are set to non-light-emitting cells or light-emitting cells in response to pixel data. Moreover, at the light-emission sustain process of each sub-field, the only aforementioned light-emitting cells are allowed to emit light only for the period of light-emission corresponding to the weight of the sub-field. Accordingly, the simultaneous reset operation and the selective erase operation are performed once, respectively, in each of the sub-field groups. According to this drive method using the selective erase addressing method, sub-fields from head to tail in each of the sub-field groups turn into a light-emitting state in sequence as the brightness to be displayed increases.

Incidentally, the above-mentioned light-emission drive patterns shown in FIG. 22 and FIG. 26 allow simultaneous application of the scan pulses SP and the high-tension pixel data pulses to generate the selective erase discharge in either one of the pixel data write processes Wc in the sub-fields SF1 through SF14.

However, if only a small amount of charged particles remain in a discharge cell, the selective erase discharge may not be generated normally even when these scan pulses SP and high-tension pixel data pulses are applied simultaneously, thereby possibly disabling the wall charges in the discharge cells to disappear. In this case, light-emission is performed corresponding to the maximum brightness even if the A/D-converted pixel data D are those showing low brightness, thereby presenting a problem of significantly reducing picture image quality.

For example, in the case where the selective erase addressing method is employed as the pixel data write method and the converted pixel data HD is

[01000000000000], as shown with the black circles of FIG. 22, the selective erase discharge is performed only at the sub-fields SF2 and the discharge cell is changed into a non-light-emitting cell at this time. This is expected to allow the sustaining light-emission to be performed only in SF1 of the sub-fields SF1 through SF14. However, if the selective erase fails in the sub-fields SF2 and wall charges remain in the discharge cells, the sustaining light-emission is performed not only in the sub-fields SF1 but also in the subsequent sub-fields SF2 through SF14, so that the display with the maximum brightness is executed.

Therefore, the present invention allows for preventing such erroneous light-emitting operation by employing the light-emission drive patterns shown in FIG. 27 to FIG. 30.

FIG. 27 through FIG. 30 are views showing examples of the light-emission drive patterns for preventing such erroneous light-emission operation and the conversion tables to be used by the second data conversion circuit 34 when such a light-emission drive is performed.

In the foregoing, FIG. 27 through FIG. 29 show all patterns of light-emission to be executed in accordance with the light-emission drive formats shown in FIG. 3 where the simultaneous reset process Rc is provided only once in one field period, respectively. The figures also show an example of the conversion table to be used by the second data conversion circuit 34 for driving the light-emission, respectively. Incidentally, FIG. 27 through FIG. 29 show a pattern of light-emission patterns to be executed in accordance with the light-emission drive format when the selective erase addressing method shown in FIG. 3 is employed, respectively.

In addition, FIG. 30 shows all patterns of light-emission to be executed in accordance with the light-emission drive format shown in FIG. 23 where the simultaneous reset process Rc is provided twice in one field period. The figure also shows an example of the conversion table to be used by the second data conversion circuit 34 for driving the light-emission.

In the foregoing, the above-mentioned light-emission drive patterns shown in FIG. 27 through FIG. 30 allow the selective erase discharge to be performed successively at the pixel data write process Wc in each of the two successive sub-fields as shown with the black circles in the figures.

According to the foregoing operation, even if the first selective erase discharge is not successful to cause the wall charges in the discharge cells to disappear in a normal manner, the second selective erase discharge is performed to allow the wall charges to disappear normally. Thus, the above-mentioned erroneous sustaining light-emission is prevented.

Incidentally, these two-time selective erase discharges need not to be performed in successive sub-fields. To sum up, the second selective erase discharge may be preferably performed in any one of the sub-fields occurring after the completion of the first selective erase discharge.

FIG. 28 is a view showing an example of the light-emission drive pattern and the conversion table of the second data conversion circuit 34, which are developed in view of such a point.

The example shown in FIG. 28 is intended to perform the second selective erase discharge at the next sub-field but only after the first selective erase discharge has been performed, as shown with the black circles of the figure.

Furthermore, the number of frequencies of the selective erase discharges within one field period is not limited to two times.

FIG. 29 is a view showing an example of the light-emission drive pattern and the conversion table of the second data conversion circuit 34, which are developed in view of such point.

Incidentally, the "*" shown in FIG. 29 shows that the logic level can be either "1" or "0" , while the triangular marks show that the selective erase discharge is performed only when the "*" takes logic "1" level.

To sum up, since the initial selective erase discharge may fail to write pixel data, the selective erase discharge is performed again in at least one of the sub-fields occurring thereafter, thereby ensuring writing of pixel data.

As described above, the drive method of a plasma display panel of the present invention allows for providing improved contrast with low power consumption while allowing to prevent quasi-contours, and providing improved display quality by stabilizing the selective erase discharge.

What is claimed is:

1. A method for driving a plasma display panel to perform gray scale display, said plasma display panel comprising pairs of row electrodes arrayed for each scan line and a plurality of column electrodes arrayed intersecting said respective row electrodes, wherein respective discharge cells are formed corresponding to respective pixels at respective intersections of pairs of said row electrodes for said respective scan lines and said plurality of column electrodes, and wherein N sub-fields form a display period of one field, with M ($2 \leqq M \leqq N$) sub-fields appearing successively within said N sub-fields being taken as a sub-field group, said method for driving a plasma display panel comprising:

a reset step for generating discharge for initializing all said discharge cells into a light-emitting cell state only in a head sub-field in said sub-field group, a pixel data writing step for applying pixel data pulses to said column electrodes for generating discharge to set said discharge cells to non-light-emitting cells in any one of the sub-fields within said one field and for applying scan pulses to one of said pair of row electrodes in synchronization with the pixel data pulses, and a light-emission sustaining step for generating discharge for causing only said light-emitting cells to emit light only for a light-emission period corresponding to a weight of said sub-field in respective sub-fields within said sub-field group, wherein sub-fields of a plurality of sub-groups classified according to pulse waveforms of said scan pulses of respective sub-fields exist in said sub-field group and at least one of the pulse widths and pulse voltages of said scan pulses within sub-fields belonging to a first sub-group including at least a head sub-field of said sub-field group is set larger than respective values of the same of said scan pulses within a sub-field belonging to another sub-group.

2. The method for driving a plasma display panel according to claim 1, wherein said pixel data writing step is executed by the same operation both in any one of the sub-fields in said sub-field group and in at least one sub-field occurring chronologically after one of the sub-fields.

3. The method for driving a plasma display panel according to claim 2, wherein said pixel data writing step is executed by the same operation both in any one of the sub-fields in said sub-field group and in a sub-field occurring chronologically immediately after one of the sub-fields.

4. The method for driving a plasma display panel according to claim 1, wherein said sub-field group comprises said N sub-fields.

5. The method for driving a plasma display panel according to claim 1, wherein in a sub-field occurring finally chronologically in said sub-field group, a step for applying an erase pulse to one of said respective row electrodes in order to generate discharge for setting all said discharge cells to non-light-emitting cells after said light-emission sustaining step.

6. The method for driving a plasma display panel according to claim 1, wherein wall charges are formed in all said discharge cells in said reset step, and said wall charges are selectively erased by applying said pixel data pulse and said scan pulse in said pixel data writing step.

7. The method for driving a plasma display panel according to claim 4, wherein in respective n (n=0 to N) sub-fields successive from the head of said N sub-fields in said sub-field group, N+1 gray scale drive is performed by sustaining said light-emitting cells.

8. A method for driving a plasma display panel to perform gray scale display, said plasma display panel comprising pairs of row electrodes arrayed for each scan line and a plurality of column electrodes arrayed intersecting said respective row electrodes, wherein respective discharge cells are formed corresponding to respective pixels at respective intersections of pairs of said row electrodes for said respective scan lines and said plurality of column electrodes, and wherein N (N is an integer equal to 2 or more) sub-fields form a display period of one field, said method for driving a plasma display panel comprising:

a reset step for generating discharge for initializing all said discharge cells into a light-emitting cell state only in said head sub-field in said one field, a pixel data writing step for applying pixel data pulses to said column electrodes for generating discharge to set said discharge cells to non-light-emitting cells in any one of the sub-fields within said one field and for applying scan pulses to one of said pair of row electrodes in synchronization with the pixel data pulses, and a light-emission sustaining step for applying sustain pulses to said row electrodes alternately and sequentially in order to generate discharge for causing only said light-emitting cells to emit light only for a light-emission period corresponding to a weight of said sub-field in respective sub-fields within said one field, wherein at least one of the pulse widths and pulse voltages of said sustain pulses to be applied finally at said light-emission sustaining step is set larger than the pulse widths and pulse voltages of said sustain pulses to be applied at some midpoint in the same light-emission sustaining step.

9. A method for driving a plasma display panel to perform gray scale display, said plasma display panel comprising pairs of row electrodes arrayed for each scan line and a plurality of column electrodes arrayed intersecting said respective row electrodes, wherein respective discharge cells are formed corresponding to respective pixels at respective intersections of pairs of said row electrodes for said respective scan lines and said plurality of column electrodes, and wherein N (N is an integer equal to 2 or more) sub-fields form a display period of one field, with M ($2 \leqq M \leqq N$) sub-fields occurring successively within said N sub-fields being taken as a sub-field group, said method for driving a plasma display panel comprising:

a reset step for generating discharge for initializing all said discharge cells into a light-emitting cell state only in said head sub-field in said sub-field group, a pixel data writing step for applying pixel data pulses to said column electrodes for generating discharge to set said discharge cells to non-light-emitting cells in any one of the sub-fields within said sub-field group and for applying scan pulses to one of said pair of row electrodes in synchronization with the pixel data pulses, and a light-emission sustaining step for applying sustain pulses to said row electrodes alternately and sequentially in order to generate discharge for causing only said light-emitting cells to emit light only for a light-emission period corresponding to a weight of said sub-field in respective sub-fields within said sub-field group, said drive method wherein at least one of the pulse widths and pulse voltages of said sustain pulses to be applied finally at respective light-emission sustaining steps in said sub-field group is set larger than the pulse widths and pulse voltages of said sustain pulses to be applied at some midpoint in the same light-emission sustaining step.

10. The method for driving a plasma display panel according to claim 9, wherein at least one of the pulse widths and pulse voltages of said sustain pulses to be applied finally at a light-emission sustaining step of a sub-field occurring later chronologically in said sub-field group is set larger than the pulse widths and pulse voltages of said sustain pulses to be applied at some midpoint in the same light-emission sustaining step.

11. The method for driving a plasma display panel according to claim 10, wherein at least one of the pulse widths and pulse voltages of said sustain pulses to be applied at light-emission sustaining stepes of a sub-field occurring earlier chronologically in said sub-field group is set larger than the pulse widths and pulse voltages of said sustain pulses to be applied at some midpoint in a light-emission sustaining step of a sub-field occurring later chronologically in said sub-field group.

12. The method for driving a plasma display panel according to claim 10, wherein at least one of the pulse widths and pulse voltages of said sustain pulses to be applied finally at light-emission sustaining stepes of a sub-field occurring earlier chronologically in said sub-field group is set larger than the pulse widths and pulse voltages of said sustain pulses to be applied finally in a light-emission sustaining step of a sub-field occurring later chronologically in said sub-field group.

13. The method for driving a plasma display panel according to claim 9, wherein respective sub-fields within said sub-field group form a plurality of sub-groups and at least one of the pulse widths and pulse voltages of said scan pulses within sub-fields belonging to a first sub-group including at least a head sub-field of said sub-field group is set larger than respective values of the same of said scan pulses within a sub-field belonging to another sub-group.

14. The method for driving a plasma display panel according to claim 8, wherein said pixel data writing step is executed by the same operation both in any one of the sub-fields in said sub-field group and in at least one sub-field occurring chronologically after one of the sub-fields.

15. The method for driving a plasma display panel according to claim 14, wherein said pixel data writing step is executed by the same operation both in any one of the sub-fields in said sub-field group and in a sub-field occurring chronologically immediately after one of the sub-fields.

16. The method for driving a plasma display panel according to claim 9, wherein said sub-field group comprises said N sub-fields.

17. The method for driving a plasma display panel according to claim 16, wherein in said sub-field group, brightness is increased, in addition to a sub-field allowed at the first-level gray scale for emitting light at the second-level gray scale lower by one level than said first-level gray scale, by allowing another sub-field to be operated to emit light.

18. The method for driving a plasma display panel according to claim 9, wherein in a sub-field occurring finally chronologically in said sub-field group, a step for applying an erase pulse to one of said respective row electrodes in order to generate discharge for setting all said discharge cells to non-light-emitting cells after said light-emission sustaining step.

19. The method for driving a plasma display panel according to claim 9, wherein wall charges are formed in all said discharge cells in said reset step, and said wall charges are selectively erased by applying said pixel data pulse and said scan pulses in said pixel data writing step.

* * * * *